US009089752B2

(12) United States Patent
Ochi

(10) Patent No.: US 9,089,752 B2
(45) Date of Patent: Jul. 28, 2015

(54) FLOOR MECHANISM FOR GAME DEVICE AND GAME DEVICE USING SAID FLOOR MECHANISM FOR GAME DEVICE

(71) Applicant: BLD Oriental, Co., Ltd., Izumisano Osaka Prefecture (JP)

(72) Inventor: Yasushi Ochi, Izumisano (JP)

(73) Assignee: BLD Oriental Co., Ltd., Osaka (JP)

( * ) Notice: Subject to any disclaimer, the term of this patent is extended or adjusted under 35 U.S.C. 154(b) by 0 days.

(21) Appl. No.: 14/355,293

(22) PCT Filed: Oct. 24, 2012

(86) PCT No.: PCT/JP2012/006815
§ 371 (c)(1),
(2) Date: Aug. 27, 2014

(87) PCT Pub. No.: WO2013/069219
PCT Pub. Date: May 16, 2013

(65) Prior Publication Data

US 2015/0045151 A1 Feb. 12, 2015

(30) Foreign Application Priority Data

Nov. 9, 2011 (JP) ..... 2011-245168

(51) Int. Cl.
*A63G 3/00* (2006.01)
*A63B 67/00* (2006.01)
*A63B 9/00* (2006.01)

(52) U.S. Cl.
CPC ..... *A63B 67/002* (2013.01); *A63B 9/00* (2013.01)

(58) Field of Classification Search
CPC ..... A63G 3/00; A63G 3/02; A63G 31/00; A63G 31/12; A63B 2225/25; E04H 15/20; E04H 15/22; E04H 2015/201; E04H 2015/202; E04H 2015/206; C08G 18/10; C08G 18/6644; C08G 18/6677
USPC ..... 472/134–137; 446/220, 225, 226; 52/2.11, 2.18, 2.21, 2.22, 2.24
See application file for complete search history.

(56) References Cited

U.S. PATENT DOCUMENTS 6,282,842 B1 * 9/2001 Simens ..... 52/2.11
6,364,782 B1 * 4/2002 Ochi ..... 472/134
7,311,610 B2 12/2007 Ochi

FOREIGN PATENT DOCUMENTS

JP 11137857 A 5/1999
JP 2004208844 7/2004
WO 03070345 8/2003
WO 2006022004 A1 3/2006

* cited by examiner

*Primary Examiner* — Kien Nguyen
(74) *Attorney, Agent, or Firm* — Stevens & Showalter LLP

(57) ABSTRACT

To provide a floor mechanism for game devices, that displaces as a result of user movement, and a game device using said floor mechanism for game devices.
A floor mechanism for game devices, comprising a frame, a floor sheet, and an air suction/sending structure. The frame comprises a plurality of props installed upon a floor surface and coupling members that couple the adjacent plurality of props. The floor sheet is arranged in an airtight state on the coupling members for the frame; and the air suction/sending structure sends air to or sucks air from an airtight space formed by side surface members provided in the frame, and the floor sheet. The floor mechanism is characterized by forming the airtight space as a result of the floor sheet being fixed to the frame by a fixing structure.

18 Claims, 25 Drawing Sheets

(A)

(B)

(A)

(B)

(A)

(B)

(A)

(B)

(C)

(D)

(A)

(B)

(A)

(B)

FLOOR MECHANISM FOR GAME DEVICE AND GAME DEVICE USING SAID FLOOR MECHANISM FOR GAME DEVICE

TECHNICAL FIELD

This invention relates to a floor mechanism for game devices and a game device using said floor mechanism for game devices.

BACKGROUND ART

The game device with a floor can be moved is popular with users such as the child, and the demand from the playground equipment maker is high. For example, the game device which a floor can slant toward is disclosed in Japanese Unexamined Patent Application Publication No. 2010-005224.

SUMMARY OF THE INVENTION

To support the game device main body, the floor of the game device generally does not often move. A floor only slanted toward simply saying that it was displaced, the floor is only slanted simply even if it is moved like a playground equipment disclosed in above patent document. For users (young users such as child, the same shall apply hereinafter), a floor of the game device is place which often makes a contact with. Therefore, to the floor making a complicated moving, the user is considerably interested.

However, mechanical design is complicated that movement such as the slant of the floor is configured by only crank, as described in the prior art. Therefore, the playground equipment maker designs so as not to move the floor of the game device. On the other hand, the floor which moves by simple configuration is called for from the playground equipment maker because the game device comprising a floor moving as above is popular with users. The object of the invention is to give a floor mechanism for game devices variously moving by simple configuration and a game device using said floor mechanism for game devices.

The present invention to solve the problem is a floor mechanism for game devices provided with a frame, a floor sheet and with an air suction/sending means. The frame comprises a plurality of struts vertically arranged on the floor and a coupling member for coupling the adjacent of said plurality of struts. The floor sheet is arranged in an airtight state on the coupling members for the frame, and the air suction/sending means sends air to or sucks air from an airtight space formed by side surface members provided in the frame, and the floor sheet. The floor mechanism is characterized by forming the airtight space as a result of the floor sheet being fixed to the frame by a fixing means.

By the above configuration, the floor sheet body swells out by sending out air by an air sending means. A floor sheet will be moved up and down by user's jumping over the floor sheet body. The game device, which can continue the interest of the user for a long time, can be configured by a floor moving up and down as above. In above configuration, it is preferable that the floor sheet is a boxiness floor sheet formed with an erected sheet erecting all the corners and sides of the flat sheet. The corner of the erected sheet of the boxiness floor sheet is fixed to inside corner of the frame by a fixing means, and the side of the erected sheet is fixed to an inside side of the frame by the fixing means. The boxiness floor sheet rising the all corners and side part of the flat sheet can tightly fix a corner (an outside corner) of the boxiness floor sheet to the inside corner of the frame. Therefore, airtight space can be easily formed to the frame. The fixing means for fixing the corner of the erected sheet of the floor sheet to the inside corner of the frame can use an angle type clamp. The angle type clamp can fix the corner of the floor sheet and the inside corner of the frame without clearance.

In the above configuration, it is preferable that a two step of floor sheet formed by stacking two pieces of the boxiness floor sheet up and down and by coupling the plurality of the boxiness floor sheet to each other by a tube-shaped sheet, is provided. The coupling members of the frame are placed in the top and bottom position. Each boxiness floor sheet of the two steps of floor sheet can be placed airtightly to the top and bottom coupling member placed to the frame. When air is filled, the expansion is regulated regarding the part coupled with a top edge of the tube-shaped sheet among the boxiness sheets by connecting the boxiness sheet to the top and bottom edges of the tube-shaped sheet. Therefore, a boxiness sheet can form the convexoconcave.

It is desirable for the floor sheet to comprise a translucent member. Furthermore, it is desirable that the floor sheet is a bag shape floor sheet stacking two pieces of the transparent sheet, and that the air suction/sending means sends out air to the space in the bag shape floor sheet formed of the transparent sheet. In the above configuration, a concave part is formed on the upper part of the floor sheet by absorbing air in the floor sheet by the air suction/sending means, and a ball can be placed in the concave part.

In the above configuration, a cycling mechanism to circulate a cycling body is placed in the floor sheet lower part. It is desirable that the cycling body is circulated in the floor sheet which air is sent by the air suction/sending means. In the above configuration, the floor sheet body swells out by sending out air by an air sending means. Furthermore, by cycling mechanism, a cycling body circulates through the floor sheet body. While a cycling body circulates, the floor sheet moves up and down by user's jumping over the floor sheet while looked at the cycling of the cycling body. By moving the floor up and down as above, the game device which can continue the interest of the user for a long time can be configured.

In the above configuration, it is desirable for a cycling body to circulate within a support member and floor sheet placed on the coupling members. It is preferable that the cycling mechanism comprise a receiving side flowpath and sending side flowpath and a cycling device. The receiving side flowpath receives a cycling body dropped from the space in the floor sheet, the sending side flowpath ejects the cycling body received by the receiving side flowpath to the airtight space in the floor sheet, and the cycling device sends a cycling body to the floor sheet via sending side flowpath.

By the above configuration, for example, the floor sheet swells out by sending air into an airtight space formed by the floor sheet support and the floor sheet. While a cycling body circulates, the floor sheet moves up and down by user's jumping over the floor sheet while looking at the cycling of the cycling body. By moving the floor up and down as above, the game device which can continue the interest of the user for a long time can be configured.

In the above configuration, the cycling body can be a ball placed on the support member, and the ball can be circulated in the frame by a blower provided for the cycling mechanism. Furthermore, in accordance with an aspect of the present invention, the cycling body can be a ball placed on the frame undersurface, and the ball can be circulated in the frame by a blower provided for the cycling mechanism. The airtight space formed by providing the side surface members to the frame and formed by sending out air from exterior of an air sending means becomes almost calm air. Therefore, balls can be easily circulated by the wind of the blower. Furthermore, a ball can be placed in the floor sheet as a cycling body, and a ball can circulate in the floor sheet by the blower provided to the cycling mechanism. A ball can be sent to the floor sheet by the air sending means to send out air in floor sheet via the sending side flowpath.

In the above configuration, a cycling body is water, a cycling device is a submersible pump, and a nozzle provided in the end of the sending side flowpath can gush water. A fountain can be generated in the floor sheet by gushing water from the nozzle provided in the end of the sending side flowpath. In the above configuration, a water bag floor sheet comprising a water bag capable of being filled watertightly with a liquid can be used. A cushioning material can be provided around the floor sheet. The air sending means can be regulated so that air capacity that a liquid in the water bag is pushed, can be sent into the water bag floor sheet when a user steps on the water bag floor sheet.

A plurality of the floor mechanisms for game devices 100 as described above can be provided. A pipe to airtightly connect between each floor mechanism for game devices is provided, and one air suction/sending means commonly can be used for sending out air to each floor mechanism for game device. Furthermore, a game device using the floor mechanism for game devices can be configured. For example, a seesaw-type game device can be configured.

A slide type game device can be configured. The coupling member is a slant coupling member for slantly coupling between the struts. A plurality of tube-shaped sheets provided to the floor sheet back surface can be provided and a drawbar housed in the tube-shaped sheet can be provided. A convexo-concave for slide is formed in the floor sheet by fixing the drawbar to the board member placed in the slant coupling member. A connector for forming a hook in the floor sheet can be formed. The connector includes an upper connector and a pair of the bottom connectors. A string can be provided on the under surface of the upper connector for hanging the hook. The pair of bottom connectors can engage for the upper connector, in the condition of sandwiching the string provided to the upper connector.

The present invention is a floor mechanism for game devices comprising a frame, floor sheet support member, floor sheet, and an air sending means. The floor sheet support member is placed on the upper part of the frame, and the floor sheet is airtightly supported on the floor sheet support member. The air sending means sends out air to an airtight space formed in the floor sheet.

Furthermore, a cycling mechanism to circulate a cycling body is placed in the floor sheet lower part. The cycling body is circulated in the floor sheet which air is sent by the air suction/sending means.

By the above configuration, the floor sheet body swells out by sending out air by an air sending means. A floor sheet will be moved up and down by a user's jumping over the floor sheet body. The game device, which can continue the interest of the user for a long time, can be configured by a floor moving up and down as above.

DESCRIPTION OF THE PREFERRED EMBODIMENT

Preferred Embodiment 1

Figure 1:
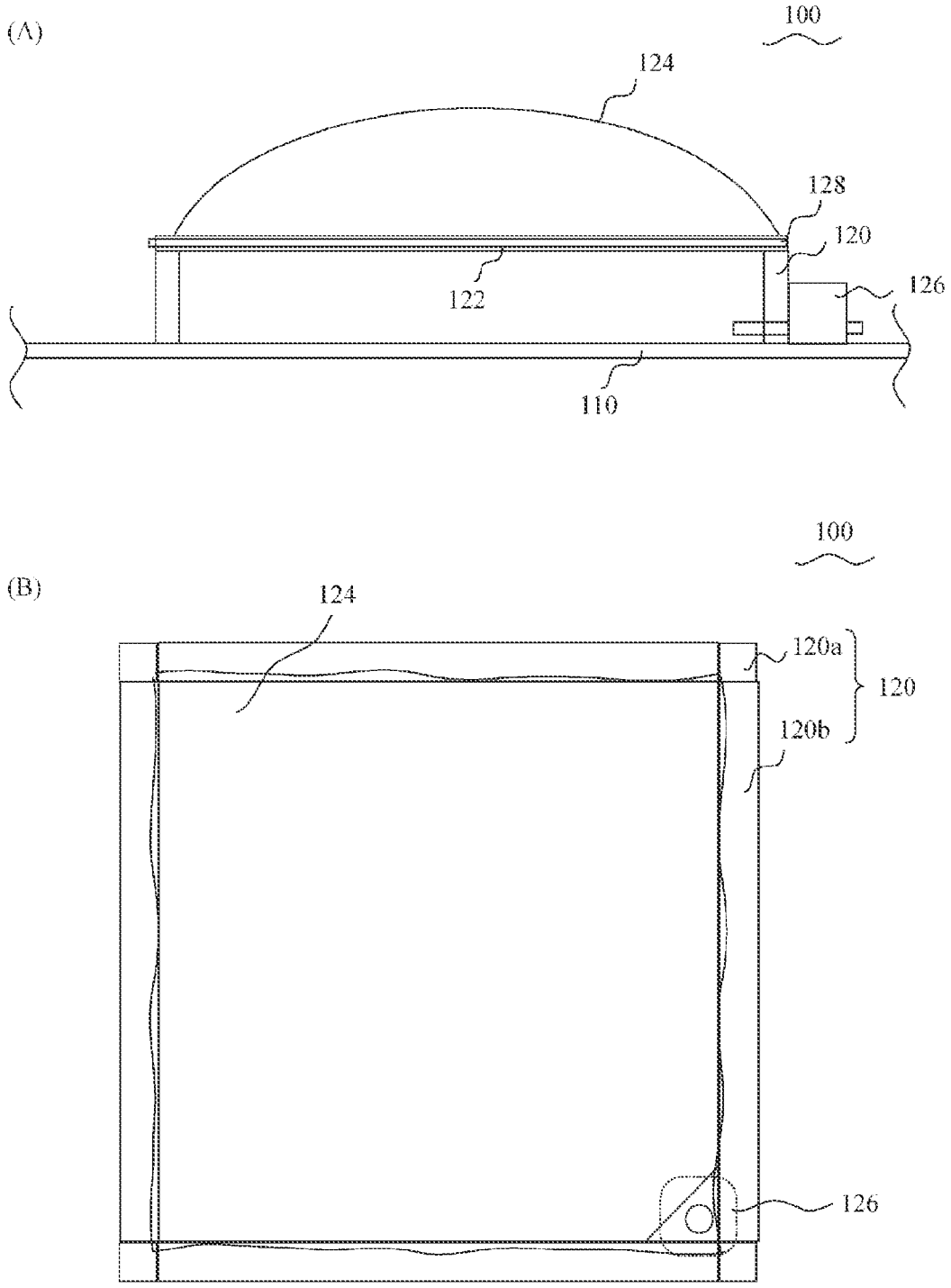
FIGS. 1(A) and 1(B) are a front and plane view illustrating an outlined configuration of a floor mechanism for game devices in accordance with an embodiment of the present invention.
Figure 2:
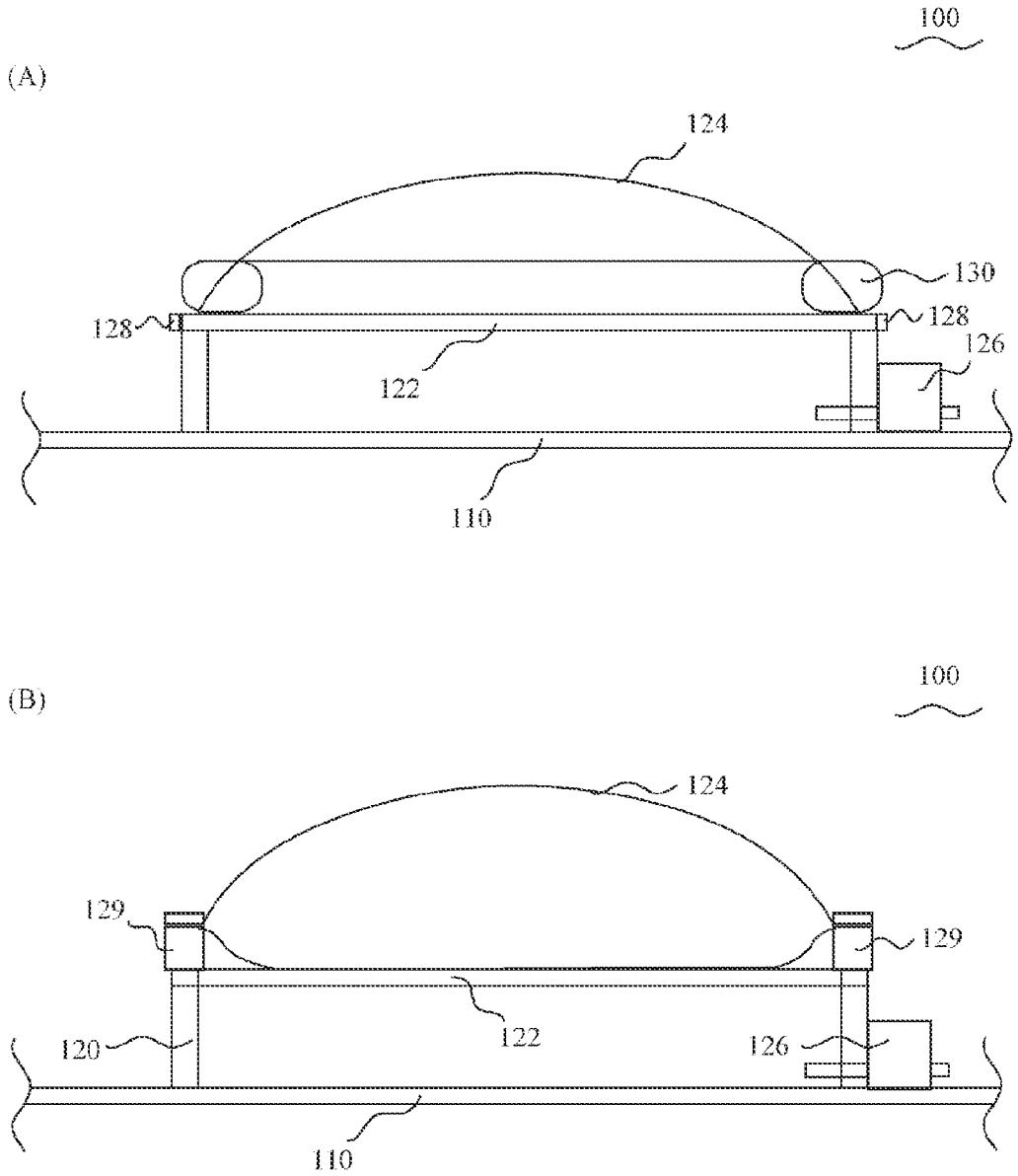
FIGS. 2(A) and 2(B) are front views illustrating an outlined configuration of a floor mechanism for game devices in accordance with an embodiment of the present invention.
Figure 3:
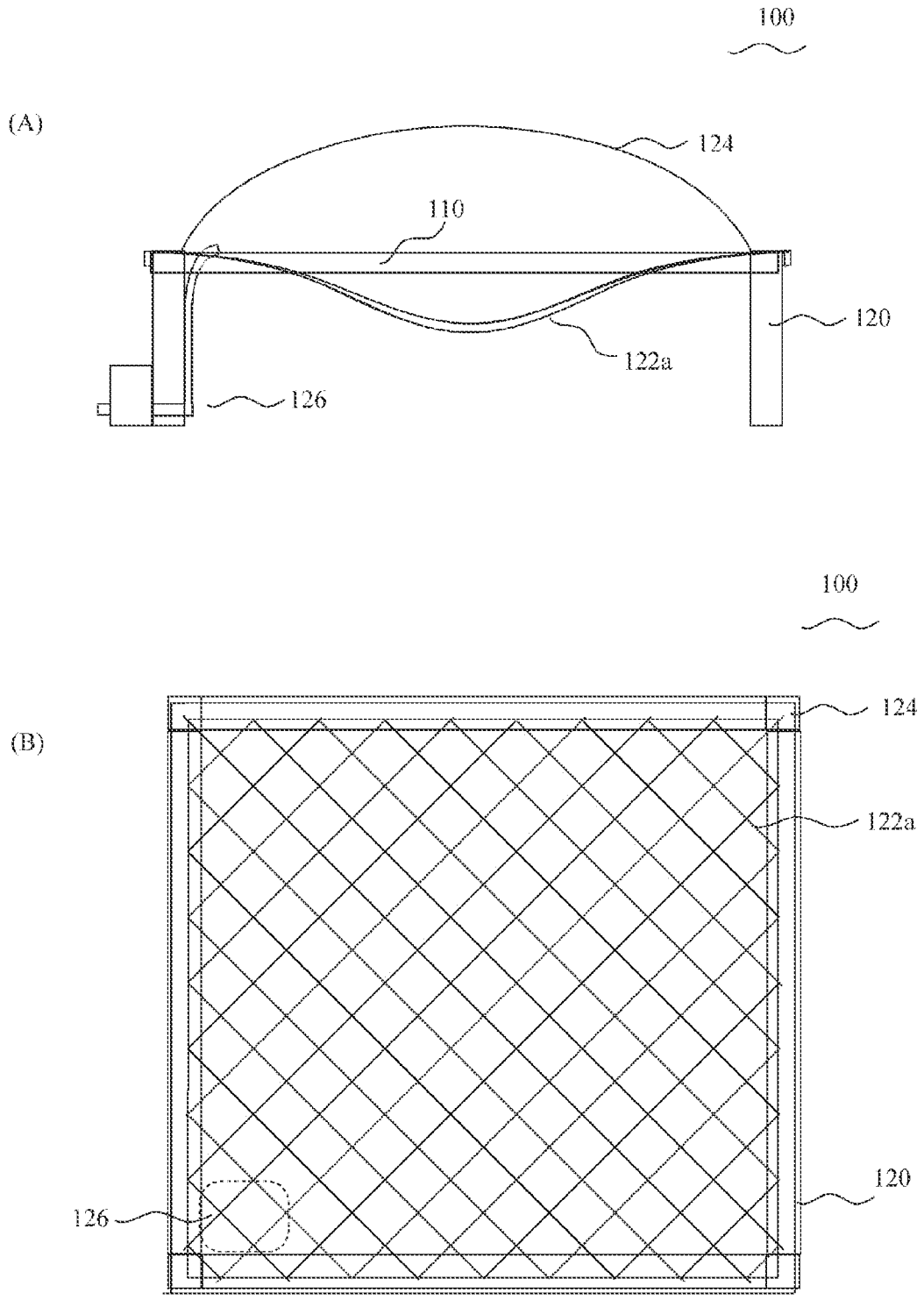
FIGS. 3(A) and 3(B) are a front and plane view illustrating an outlined configuration of a floor mechanism for game devices in accordance with an embodiment of the present invention.

A specified embodiment of a floor mechanism for game devices 100 is explained hereinafter with reference to the accompanying drawings. FIGS. 1, 2 and 3 are outline schematic views showing the whole configuration of a floor mechanism for game device 100 of the present example. However, the details of the parts which do not directly-relate to the present invention will be omitted. First, a frame 120 is placed on a floor 110. In accordance with this exemplary embodiment, a rectangular frame is placed on the floor 110. That is, a plurality of struts 120*a* are prepared, and each strut 120*a* is vertically arranged to the four corner parts of the rectangular frame 120. The rectangular frame 120 shown in FIG. 1 (A) and FIG. 1 (B) is formed by horizontally coupling the upper parts of each adjacent column by the coupling members 120*b*. One or plurality of struts 120*a* (side portion) are vertically arranged between each adjacent strut 120*a* among each strut 120*a* of the four corners. The rectangular frame 120 is formed by horizontally coupling the upper parts of each opposed strut 120*a* among each strut 120*a* of the side portion, by the coupling members 120*b*. The rectangular frame 120 is formed on the floor 110 by placing a floor sheet support member 122 for supporting an after-mentioned floor sheet 124 on the upper part of the rectangular frame 120. The floor sheet 124 can be directly placed on the coupling members 120*b*.

A floor sheet 124 is supported with airtight condition to the frame 120. For example, a floor sheet support member 122 for supporting the floor sheet 124 is formed by a board member, and the floor sheet support member 122 is horizontally fixed to the floor on frame 120. The floor sheet support member 122 has an opening formed in the given point. The floor sheet 124 is airtightly supported around the floor sheet support member 122. In the present embodiment, as shown in FIG. 2 (A), the floor sheet 124 is sheeted on the board member (corresponding to a floor sheet support member 122). A fixing member 128 airtightly fixes around the floor sheet 124. Alternatively, as shown in FIG. 2 (B), a wall 129 is provided around the board member, and the floor sheet 124 can be airtightly fixed to the wall 129. Of course a side surface member is provided on a side of the frame 120, and an airtight space is formed by frame 120, side surface members, floor sheet 124. The floor sheet 124 will swell out in bag shape by sending out air to the floor sheet 124 airtightly supported by the fixing member 128 or wall 129 from exterior. In the present embodiment, a square-formed floor sheet 124 is used. The above floor sheet corresponds to the floor sheet of this invention. The floor sheet 124 can be placed on the coupling members 120*b* without placing the floor sheet support member 122.

Furthermore, an air sending means such as a blower 126 for sending out air within the floor sheet 124 is provided to the frame 120. In the present embodiment, the blower 126 is fixed outside of the frame 120. The floor sheet support member 122 is provided with a small hole for sending air to the above floor sheet 124 from the blower 126. The air outlet provided to the blower 126 can couple to the small hole by an air flowpath. The floor mechanism for game devices 100 is configured by forming the floor sheet 124 as described above.

Liquids such as water are put into the space formed by floor sheet 124 and floor sheet support member 122, and a plurality of small ball can be put on the surface of the water. The floor sheet 124 employs translucent raw material in the present example. By configuring as above, the floor sheet 124 is expanded by sending out air to the space formed by the floor sheet 124 and floor sheet support member 122 by blower 126. Users can jump up and down on the floor sheet blown by sending air while viewing the small ball floating on water because the floor sheet 124 is formed of translucent raw material as described above.

Furthermore, the water bag formed by injecting liquids such as water into a translucent sheet formed in the bag shape can be inserted within above floor sheet 124. At this time, by adjusting quantity of air outgoing of blower 126, when users step on the floor sheet 124, the air capacity in floor sheet 124 is kept so that the users touch the water bag. The floor mechanism for game devices as configured above can give a feeling as if the users play with water.

Furthermore, as shown in FIG. 2 (A), the edge of floor sheet 124 can be surrounded with downfall prevention member 130. For example, a plurality of cylinders are formed, and by placing each cylinder in the rectangle (square shape, in the present example) and by coupling an adjacent cylinder by welding, oval annular downfall prevention member 130 is formed. A floor mechanism for game devices 100 comprising the downfall prevention member 130 is formed by surrounding the floor sheet 124 by the downfall prevention member 130 formed as above. Of course the sheet forming the downfall prevention member 130 is provided with a small hole for sending air from the blower 126, and air is sent from the blower 126 via said small light guide hole. The downfall prevention member 130 can be formed of elastic raw material such as urethane. The downfall prevention member 130 corresponds to the cushioning material of this invention.

Alternatively, as shown in FIG. 3, space can be formed in the bag shape floor sheet 124 by forming the floor sheet 124 into bag shape. Of course, a small hole for sending air from blower 126 is formed to the bag shape floor sheet 124. The edge of two pieces of laminated sheets is fixed, and the bag shape floor sheet 124 can be formed by sending air between both sheets. An edge of the bag shape floor sheet 124 can be joined and can simply fix if it swells out in bag shape by sending air.

It is desirable that the floor sheet support member 122 can be formed of elastic organ when the bag shape floor sheet 124 is employed. This is because it can prevent the bag shape floor sheet 124 is swollen downward. In accordance with exemplary embodiments, as shown in FIG. 3 (B), the floor sheet support member 122 is formed of net member 122*a*. That is, a net member 122*a* for supporting the bag shape floor sheet 124 is placed on the upper part of the frame 120 configured as above. For example, a corner and side portion of the net member 122*a* are coupled with rectangular frame 120 by rope or other members. In accordance with exemplary embodiments, the net member 122*a* corresponds to the floor sheet support member 122. Any shape of frame 120 can be used, and if the net can be coupled, a top view circle shape and top view oval configuration can be used.

The bag shape floor sheet 124 is placed on the net member 122*a* of the frame 120 configured as above. Of course a blower 126 for sending air to the bag shape floor sheet 124 is provided to any of the frame 120. Furthermore, as shown in FIG. 2 (A), the edge of the floor sheet 124 can be surrounded with a downfall prevention member 130. For example, a plurality of cylinders are formed by same raw material of the floor sheet 124. By placing each cylinder in the rectangle (square shape, in the present example) and by coupling an adjacent cylinder by welding, the oval annular downfall prevention member 130 is formed. A floor mechanism for game devices 100 comprising the downfall prevention member 130 is formed by surrounding the floor sheet 124 by the downfall prevention member 130 formed as above. Of course the sheet forming the downfall prevention member 130 is provided with a small hole for sending air from the blower 126, and air is sent via the small hole. The downfall prevention member 130 can be formed of elastic raw material such as urethane. The up-and-down motion of the strut can be prevented by fixing a cast-in anchor in the strut.

The floor sheet 124 can be formed by laminating two pieces of sheets with different modulus of elasticity. Here, a modulus of elasticity is a proportion coefficient showing relationship between distortion and stress, and it is physical properties showing the resistance for disruption. The material in which elastic modulus is high and the material which have small distortion regarding stress, are referred to as being relatively hard material. The material in which elastic modulus is low is referred to as being relatively soft material. That is, when the elastic modulus is high, the material is hard to distort. The floor sheet 124 is formed by stacking the two above sheets. That is, the floor sheet 124 is formed by placing the sheet with a high elastic modulus to the outside that is upside position and by placing the sheet with a low elastic modulus to the inside that is downside position, among different sheet of the elastic modulus. Deformation of the floor sheet 124 can be lowered even if large quantities of air from blower is sent because the sheet with a low elastic modulus is protected by the sheet with a high elastic modulus.

A plurality of the floor mechanisms for game devices 100 as described above can be provided. On this occasion, one air sending means can send out air to all floor sheets 124 by airtightly connecting the airtight space formed by each floor sheet 124 and frame 120.

Preferred Embodiment 2

In the preferred embodiment 1, the fixing member or wall 129 is placed to the floor sheet support member 122, and air is sent into the space formed by the wall part 129 and floor sheet 124. Furthermore, air is sent into the bag shape floor sheet 124 formed by the floor sheet 124 into bag shape. In the present embodiment, referring to FIG. 4, a method for fixing the floor sheet 124 and frame 120 is described further in detail.

Figure 4:
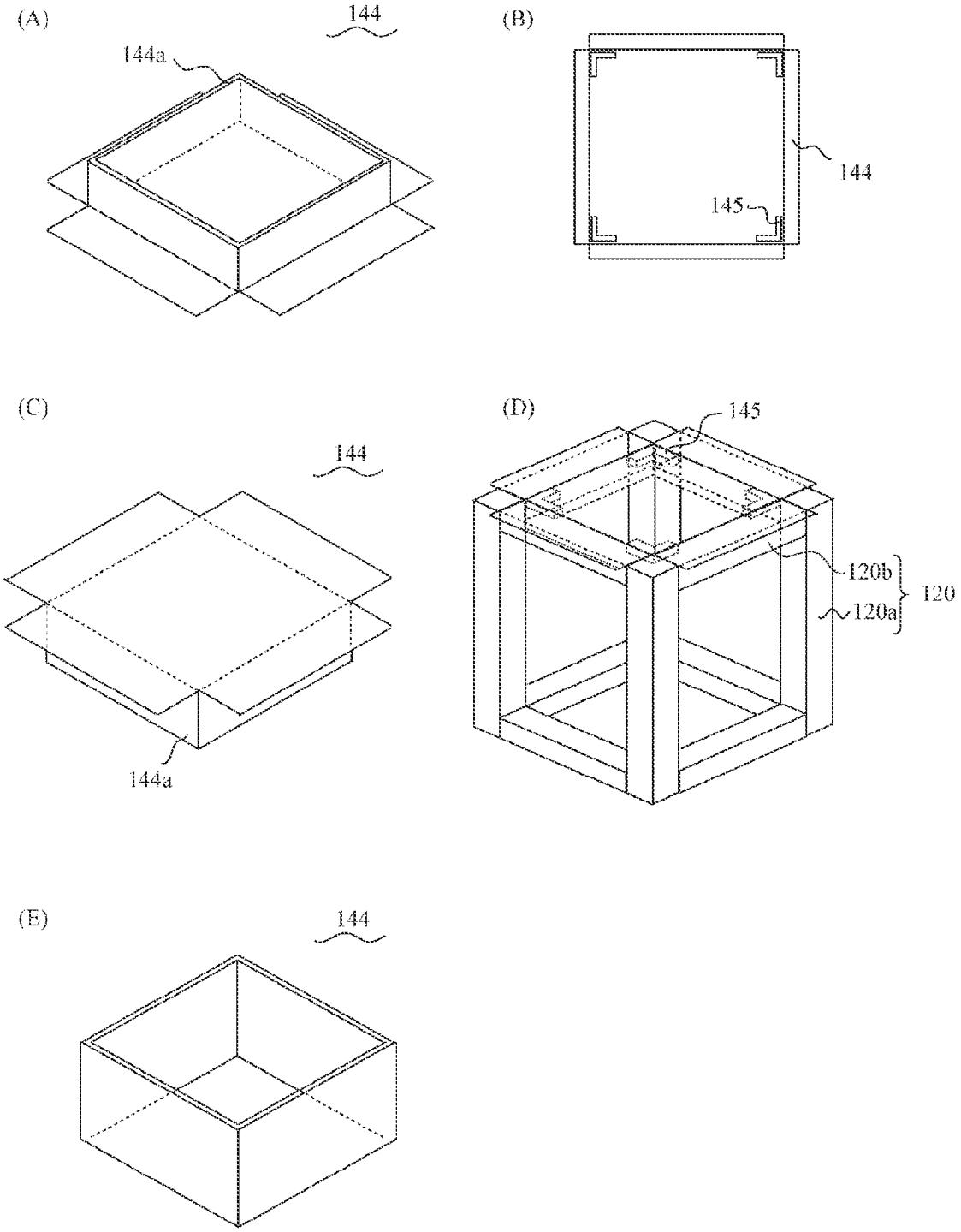
FIGS. 4(A) through 4(E) are perspective views showing the floor sheet provided in a floor mechanism for game devices in accordance with the embodiment of this invention.

At first an open topped boxiness floor sheet 144 as shown in FIG. 4 is formed. For example, in the present example, a boxiness floor sheet 144 can be formed by rising the edge of the flat sheet. All the corners and sides of the flat sheet are erected. The parts erected as described above are referred to as an erected sheet 144*a*. Airtight space is formed by sandwiching the erected sheet 144*a* between the corner of frame 120, as will hereinafter be described. Therefore, the size of the boxiness floor sheet 144 is adjusted so that the corners of the erected sheet 144*a* are sandwiched between the corners of the frame 120.

As long as the edge of the flat sheet is on a standing state, a boxiness floor sheet 144 can be configured by forming the erected sheet by welding a belt-shaped sheet on the edge of the flat sheet. Furthermore, the erected sheet 144*a* can be formed in the position spaced from an edge of the flat sheet. As discussed below, the outside of the corners of the boxiness floor sheet 144 are put inside of the corners of the frame 120. Therefore, as shown in FIG. 4 (A), the erected sheet 144*a* can be formed to the position spaced from the corners of the flat sheet. For example, it is desirable to be formed at the position spaced to the degree of coating the external diameter of the strut 120*a* configuring frame 120. Parts of coating the strut 120*a* can be cut.

The boxiness floor sheet 144 configured as above is sandwiched in the upper of the inside of the corner of the frame 120. For example, in the present example as shown in FIG. 4 (B) and FIG. 4 (D), a plurality of angle type clamps 145 capable of being fixed to the inside of corners of the frame 120 are formed. In the state the surface of the erected sheet 144*a* of the boxiness floor sheet 144 is facing downwardly, the erected sheet 144*a* of the boxiness floor sheet 144 is put between the angle type clamp 145 and the inside of the corner of the frame 120. At this time, it is preferable that the inside of the corner of the erected sheet 144*a* of the boxiness floor sheet 144 come in contact with the inside of the corner of the frame 120. Of course the side portions of the boxiness floor sheet 144 are sandwiched by a clamp. Only a side portion is sandwiched with a clamp, and clearance formed in the corners can be filled with.

In the above configuration, a configuration of fixing the boxiness floor sheet 144 to the top view rectangle shaped frame 120 is explained. In the configuration, configuration for fixing the boxiness floor sheet 144 in the top view rectangle frame 120 was explained, however the frame 120 can be a shape except rectangle. For example, various shapes of the frame 120 can be used such as a top view triangle shape or a top view pentagon shape. The boxiness floor sheet 144 is configured by forming the erected sheet 144*a* on the flat sheet to the position corresponding to the shape of the frame 120. Furthermore, the boxiness floor sheet 144 is fixed to inside of the corners of the frame 120 shaped above by an angle type clamp 145 having the angle corresponding to the inside of the corners of the frame 120 shaped above. As described above, airtight space is formed of the boxiness floor sheet 144 and the side surface members by fixing the boxiness floor sheet 144 to inside of the corners of the frame 120. Steam-tight space can be formed by fixing the inside of the corner of the boxiness floor sheet 144 to the outside of the corners of the frame 120.

Figure 5:
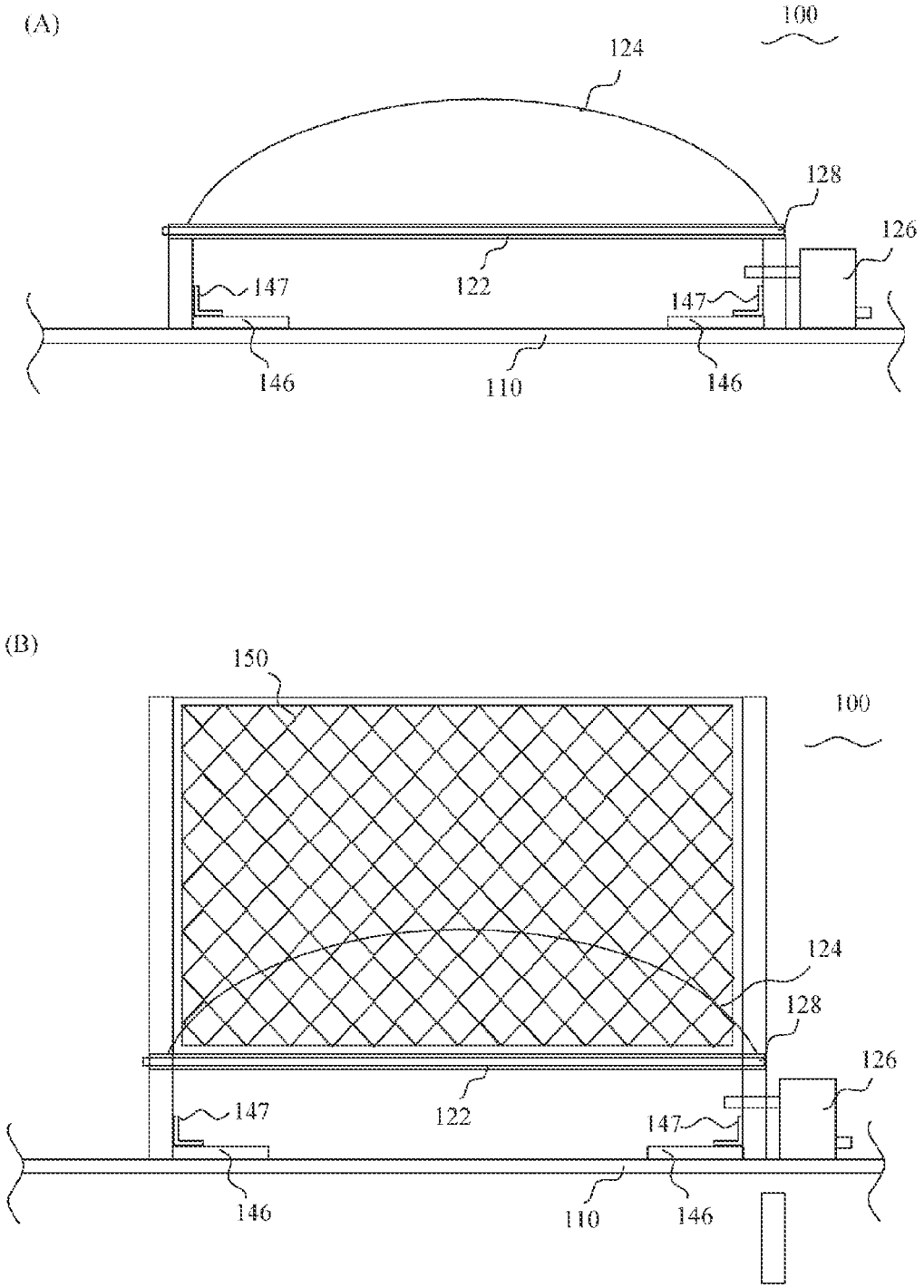
FIGS. 5(A) and 5(B) are a front and plane view illustrating an outlined configuration of a floor mechanism for game devices in accordance with an embodiment of the present invention.

The bottom face can be provided in the airtight space configured above. For example, as shown in FIG. 5, The bottom face member 146 is placed on the undersurfaces of the frame 120, and the bottom face member 146 can be fixed to the frame 120. For prevention of falling, a fall prevention sheet 160 such as nets can be placed in the upper of the frame.

Preferred Embodiment 3

In preferred embodiment 2, the fixing member or wall 129 is placed to the floor sheet support member 122, and air is sent into the space formed by the wall part 129 and floor sheet. Furthermore, air is sent into the bag shape floor sheet 124 formed by the floor sheet 124 into bag shape. In this exemplary embodiment, a floor mechanism for game devices 100 using the floor sheet 124 is further explained, with reference to FIGS. 5 and 6, and FIG. 7 from FIG. 1. Because configuration of the frame 120 placing the floor sheet 124 is the same as the detailed description of the preferred embodiment 1, illustration description is omitted.

Figure 6:
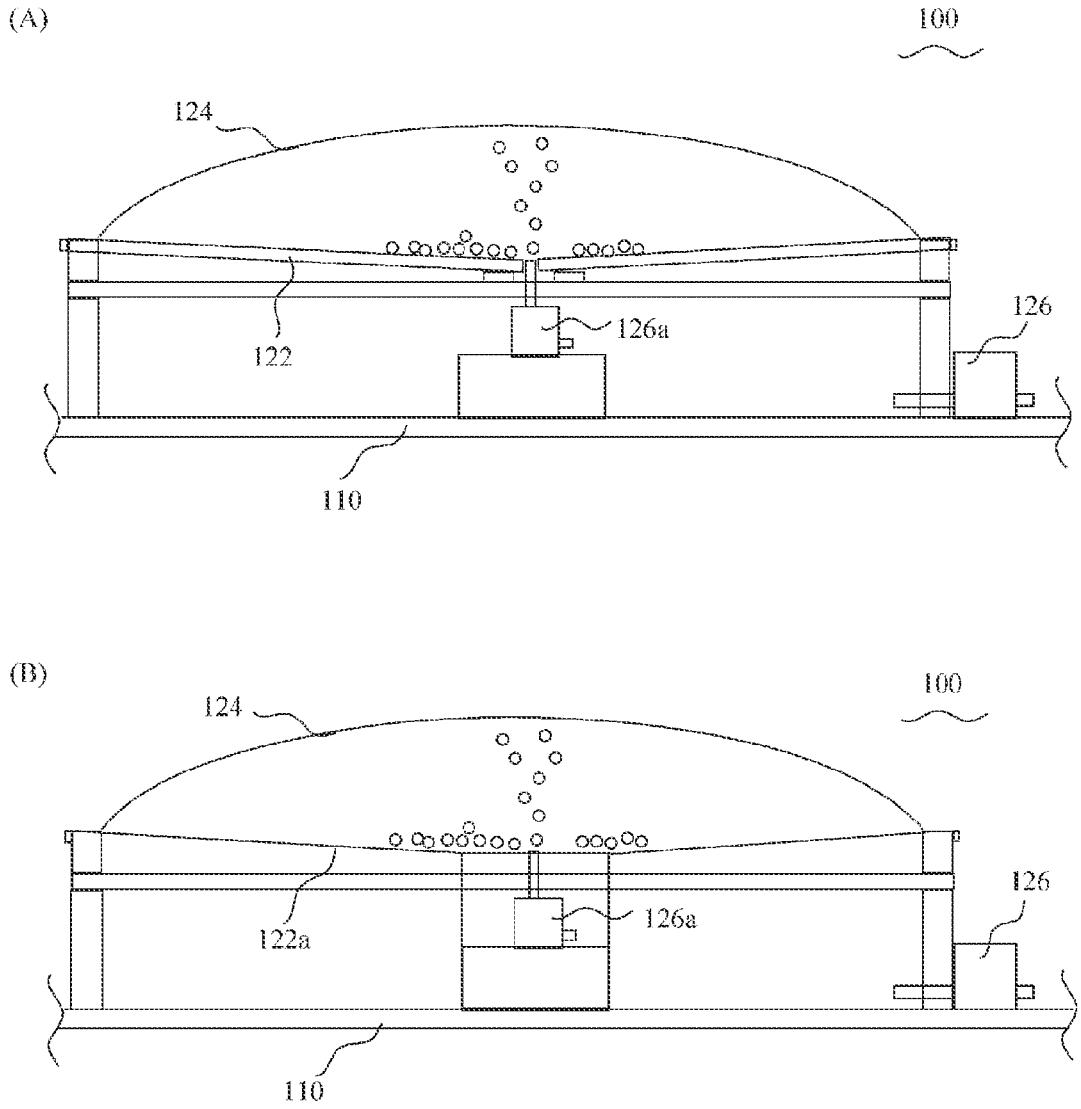
FIGS. 6(A) and 6(B) are front views illustrating an outlined configuration of a floor mechanism for game devices in accordance with an embodiment of the present invention.

As shown in FIG. 6 (A), a board member (corresponding to the floor sheet support member 122 in this invention) is placed on the frame 120 explained with detailed description of the preferred embodiment 1. The sides (the four sides of frame 120) of the frame 120 are airtightly fixed using side surface members. Of course, the floor sheet is put on the floor sheet support member 122, air is sent out to the floor sheet 124 by an air sending means of the blower 126, etc. That is, air is sent out to the airtight space formed by the frame 120, side surface members and floor sheet 124 by the above blower 126.

In the present embodiment, a plurality of balls are placed in the space formed by the floor sheet and floor sheet support member 122. Furthermore, a ball cycling blower 1 26*a* is placed in the lower parts of the floor sheet support member 122, and air is sent out to the center of the floor sheet. The plurality of balls are circulated through by sending of air by the ball cycling blower 126*a*. That is, the balls circulate through the floor sheet by sending of air from the cycling blower 126*a* when the ball approaches the neighborhood of the center. Of course, an opening for receiving the air stream from the cycling blower 126*a* is formed to the floor sheet and floor sheet support member 122. Furthermore, balls in the floor sheet 124 become easy to gather in center of the floor sheet 124 by forming the floor sheet support member sloping to the center. For example, the slope can be easily configured by forming the floor sheet support member 122 using a net.

Alternatively, a plurality of balls are placed in the bag shape floor sheet for forming the floor sheet by two pieces of sheet. Again in this case, the plurality of balls circulate by the air stream of the ball cycling blower 126*a* placed in the lower part of the floor sheet support member as above. Of course, an opening for receiving the air stream from the cycling blower is formed to the floor sheet and floor sheet support member 122.

Figure 7:
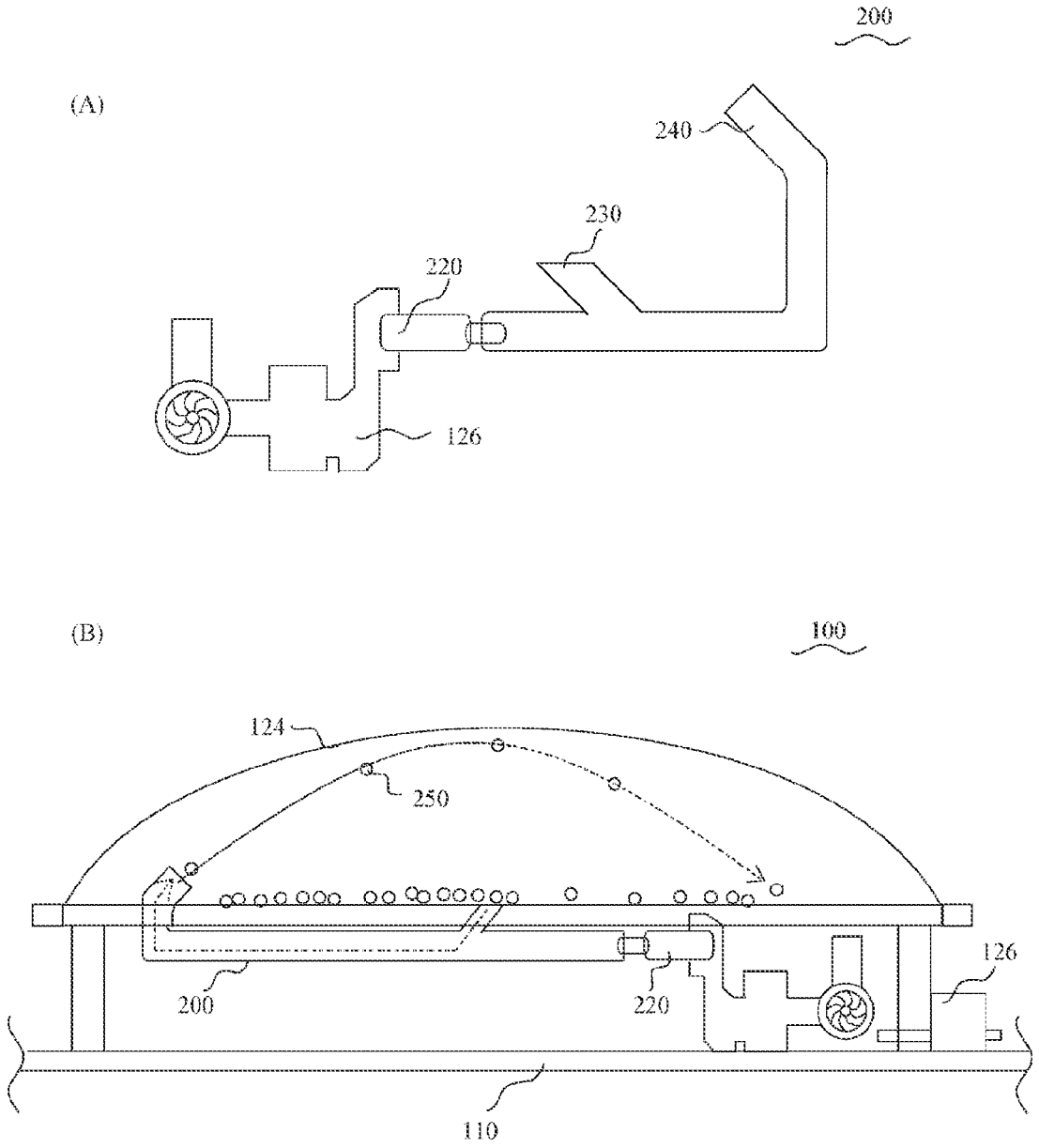
FIGS. 7(A) and 7(B) are front views illustrating an outlined configuration of a cycling mechanism of a floor mechanism for game devices in accordance with an embodiment of the present invention.

The ball 250 in the floor sheet 124 can circulate wildly by using the ball cycling mechanism 200 as shown in FIG. 7 (A). That is, the ball cycling mechanism 200 of this present example includes an air sending device such as blower 126 and a flowpath. The flowpath comprises an air outlet side flowpath 220 for directly receiving a flow of air sent out by the air outlet of blower 126, comprises a ball receiving side flowpath 230 for receiving the ball 250 in the floor sheet 124 and a ball sending side flowpath 240 for ejecting the ball 250 received by the ball receiving side flowpath 230 to the floor sheet 124.

Of course, among the flowpath, it is necessary for cycling to comprise the inside diameter that ball 250 which wants to be made to float about wildly can pass to floor sheet 124 as for at least ball receiving side flow path 230 and ball sending area flowpath 240. Each flowpath should be able to pass a flow of the air from air sending area flowpath 220, and each flowpath does not have to communicate mutually. That is, each flowpath can be placed at a specified distance.

In the present embodiment, an air sending side flowpath 220 sent out from the blower 126 and a ball sending side flowpath 240 are linked into a linear shape, and a small flowpath continuously connects to the linear shaped flowpath as the ball acceptance side flowpath 230. Furthermore, without continuously connecting with the air sending side flowpath 220 and the ball sending side flowpath 240, the ball sending side flowpath 240 is next to the outlet of the air sending side flowpath 220 with the condition that is squeezed so that outlet side opening diameter of the air sending side flowpath 220 became small. Force of the air from the blower 126 is increased by reducing the outlet side opening diameter of the air sending side flowpath 220. Flow of the air from blower 126 can be enlarged by the outlet side of air sending side flowpath 220 adjoining the entrance side of ball sending side flowpath 240. The ball cycling mechanism 200 is configured by comprising the air sending side flowpath 220, ball sending side flowpath 240, and the ball receiving side flowpath 230 for the blower 126. The blower 126 for sending out air to the floor sheet 124 is required, in addition to the blower 126 provided to the ball cycling mechanism 200.

The ball cycling mechanism 200 configured as above is placed below the floor sheet 124. In accordance with exemplary embodiments, as shown in FIG. 7 (B), the ball cycling mechanism 200 is placed in the airtight space formed by the floor sheet 124 and side surface members. At this time, the entrance of the ball receiving side flowpath 230 of the ball cycling mechanism 200 is placed in the neighborhood of the substantially center of the floor sheet 124. The exit of the ball sending side flowpath 240 of the ball cycling mechanism 200 is placed to the edge of the floor sheet 124. The balls 250 gather in the center of the floor sheet 124 easily. Therefore, the balls 250 gathered in the center of the floor sheet 124 can be received effectively by placing the entrance of the ball receiving side flowpath 230 in the center of the floor sheet 124. Furthermore, the balls 250 can be vigorously flown from the ball sending side flowpath 240 by placing the exit of the ball sending side flowpath 240 to the edges of the floor sheet 124. For example, like an arrow shown in FIG. 7 (B), the balls 250 can be flown from one end of the floor sheet 124 to other end. As above, the floor mechanism for game devices 100 of this invention is configured by placing the exit of the ball sending side flowpath 240 and by placing the entrance of the ball receiving side flowpath 230.

Preferred Embodiment 4

In preferred embodiment 1, the fixing member or wall 129 is placed to the floor sheet support member 122 and air is sent into the space formed by the wall part 129 and floor sheet. Furthermore, the space is formed in the bag shape floor sheet 124 formed by the floor sheet 124 into bag shape. In the present embodiment, a floor mechanism for game devices 100 capable of making a fountain within the floor sheet 124 is further explained with reference to FIG. 5 and FIG. 8, FIG. 9 from FIG. 1.

About the configuration other than using the fountain mechanism, because it is the same as the floor sheet for game device of the detailed description of the preferred embodiment 1 and detailed description of the preferred embodiment 2, illustration and description is omitted.

Figure 8:
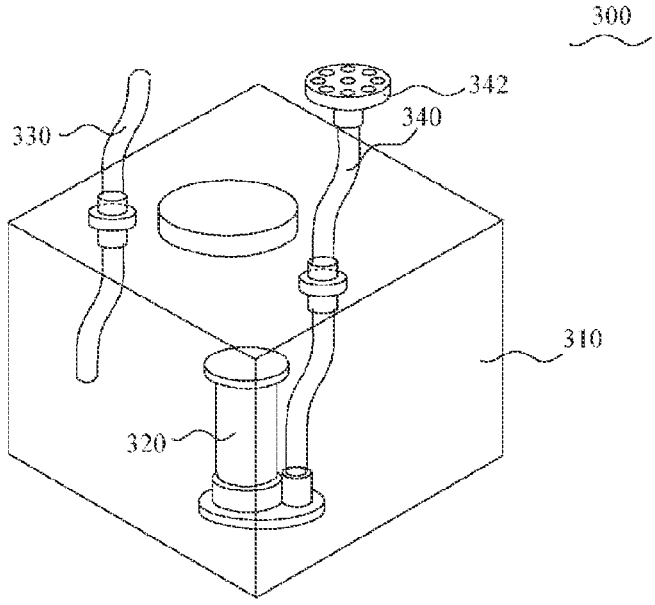
FIGS. 8(A) and 8(B) are a perspective and front view illustrating an outlined configuration of a cycling mechanism of a floor mechanism for game devices in accordance with an embodiment of the present invention.
Figure 8:
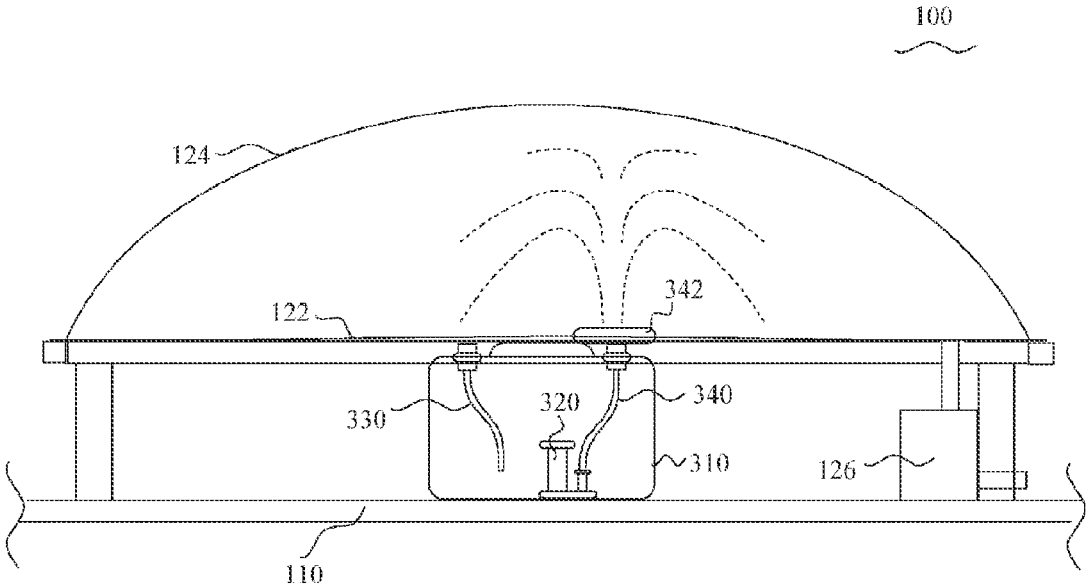

A fountain is created while circulating water in the floor sheet 124 by using a fountain cycling mechanism 300 as shown in FIG. 8 (A). That is, a fountain cycling mechanism 300 of this invention comprises a circulation of water device such as a submersible pump 320, etc. and a flowpath and a reservoir 310. The above submersible pump 320 is placed within the reservoir 310. The flowpath comprises a sending side flowpath 340 for leading water in reservoir 310 into the floor sheet 124 and comprises a receiving side flowpath 330, which liquids such as water led within floor sheet 124 is returned within the reservoir 310 by the sending side flowpath 340. In the present embodiment, an opening is opened to a cube type reservoir 310 with a cover, and the above sending side flowpath 340 is fixed inserted to the one opening. The above receiving side flowpath 330 is fixed inserted into the other opening opened out to the reservoir 310. Furthermore, the reservoir side open end (entrance) of the sending side flowpath 340 is connected to the exit of the submersible pump 320. The reservoir side open end (exit) of the receiving side flowpath 330 is hung within the reservoir 310. Of course a nozzle 342 forming a small hole for causing a fountain is connected to the entrance open and of the sending side flowpath 340. As described above, the fountain cycling mechanism 300 is configured by the sending side flowpath 340 connected to the submersible pump 320 placed within the reservoir 310, and by the receiving side flowpath 330 for returning water to the reservoir 310.

The fountain cycling mechanism 300 as described above is placed below the floor sheet 124. For preventing a water leak, the above fountain cycling mechanism 300 is placed in the airtight space formed by the two pieces of stacked transparent sheet. In accordance with exemplary embodiments, as shown in FIG. 8 (B), the above fountain cycling mechanism 300 is placed below the floor sheet 124. At this time, the receiving side flowpath 330 provided to the fountain cycling mechanism 300 is placed in the neighborhood of the center of the floor sheet 124. That is, above receiving side flowpath 330 is inserted in an opening opened in the neighborhood of the center of floor sheet 124. Therefore, the water reserved in the center of the floor sheet 124 returns within reservoir 310 via receiving side flowpath 330. Furthermore, the above sending side flowpath 340 and nozzle 342 are placed at the desired position to fountain in floor sheet 124. Therefore, the fountain accrues by gushing the water in reservoir 310 into the floor sheet 124 from the nozzle 342 of the sending side flowpath 340. A floor mechanism for game devices 100 of this invention is configured by placing the sending side flowpath 340 and receiving side flowpath 330 to the floor sheet 124.

Of course a liquid entrance and exit opening is opened in the neighborhood of the center of the floor sheet support member 122. The floor sheet 124 is placed on the floor sheet support member 124, and air sent out from the blower 126 provided to the frame 120 used in the detailed description of the preferred embodiment 1 is sent out to the floor sheet 124. Therefore, the fountain occurs in the floor sheet 124 by sending out liquid sent out from the submersible pump 320 into the floor sheet 124.

Figure 9:
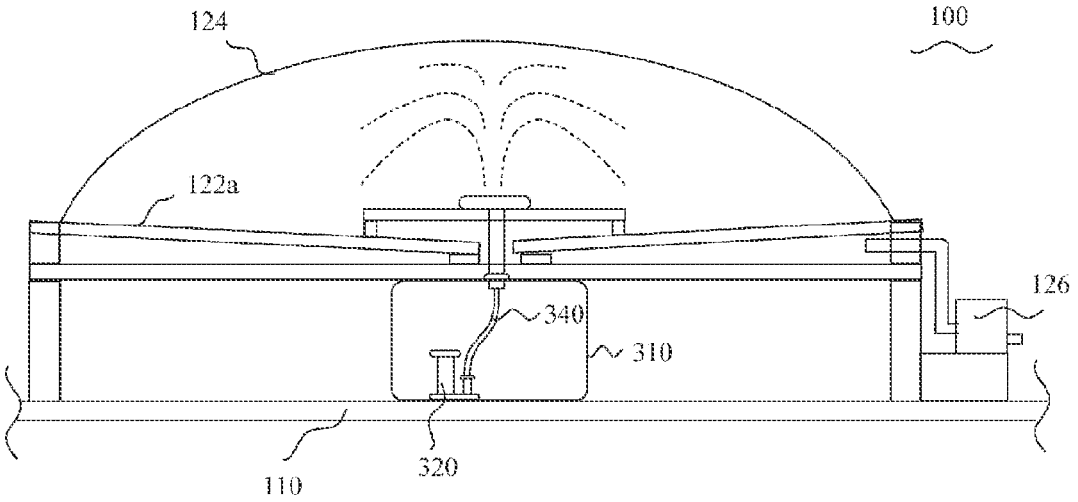
FIG. 9 is a front view illustrating an outlined configuration of a floor mechanism for game devices in accordance with an embodiment of the present invention.

An entrance and exit opening for receiving liquid from the submersible pump 320 is formed in the neighborhood of the center of the floor sheet 124. The floor sheet can be the bag shape floor sheet formed by two pieces of sheet formed into bag shape. Furthermore, as shown in FIG. 9, by forming the floor sheet 122 sloping to the center, liquids in the floor sheet 124 gather in the center of the floor sheet 124 and become easy to return to the reservoir 310 from the entrance and exit opening provided to the floor sheet 124. A color can be added to liquid reserved within the reservoir 310.

Preferred Embodiment 5

In preferred embodiment 1, the fixing member or ball 129 is placed to the floor sheet support member 122, and air is sent into the space formed by the wall part 129 and floor sheet. Furthermore, the space is formed in the bag shape floor sheet 124 formed by the floor sheet 124 into bag shape. In the present embodiment, a balloon 356, a ball, or soap bubble generator 350 is placed below the floor sheet 124. The configuration of stirring the balloons 356, balls, or soap bubbles 358 is explained with reference to FIG. 10. About the configuration other than placing the balloon 356, ball, or soap bubble generator 350, because it is the same as the detailed description of the preferred embodiment 1 and 2, illustration and description is omitted.

Figure 10:
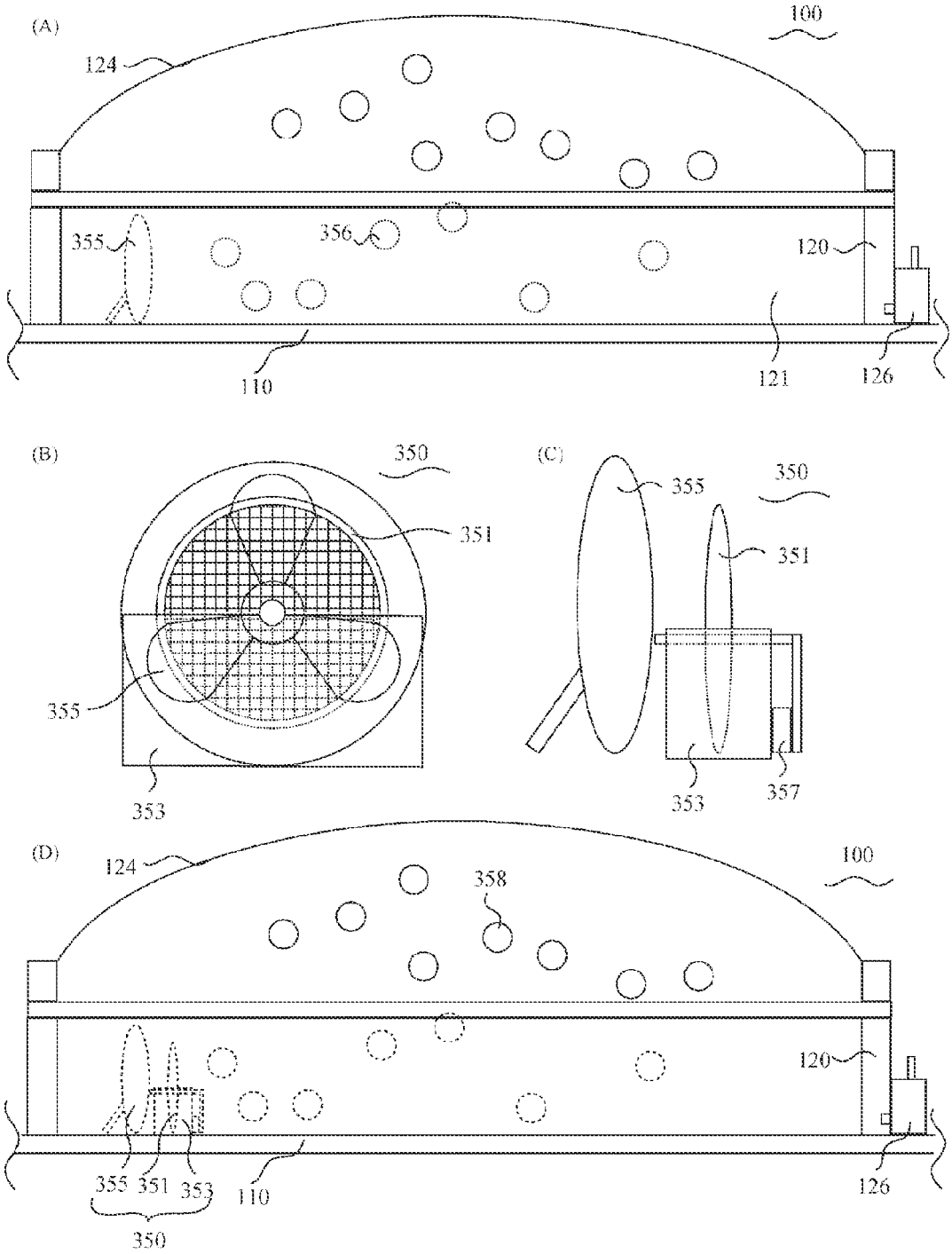
FIGS. 10(A) through 10(D) are front views illustrating an outlined configuration of a floor mechanism for game devices in accordance with an embodiment of the present invention.

As shown in FIG. 10 (A), the side of the rectangular frame 120 of the detailed description of the preferred embodiment 1 is airtightly fixed by the side surface members 121. Furthermore, airtight space is formed by the rectangular frame 120, side surface members 121, and the floor sheet 124 by coating the upper part of the rectangular frame 120 by the floor sheet. A mesh is used as a floor sheet support member for supporting the floor sheet 124.

Air is filled in the airtight space by sending air from outside into the airtight space formed as described above. In the present embodiment, air is sent into the airtight space by using an air sending means of the blower 126 etc. As described above, when the floor sheet 124 is expanded by sending the air by the blower 126, the condition in the airtight space becomes almost a calm air because there are few air streams by the blower 126. Therefore, a cycling body such as balloons 356 balls, soap bubbles 358, etc. can be easily circulated by creating the air stream in the airtight space.

For example, in the case of the balloons 356 of the cycling body, a large number of the balloons 356 of various sizes are placed on the floor (the bottom face member placed on the bottom surface of the airtight space is enough). The blowers 355 such as electric fans are placed on the position where an air stream occurs in the neighboring corner from one corner, in the rectangular frame 120 from top view. When the floor sheet 124 expands by the floor sheet 124 filled with air stream by the blower 126, the large number of balloons 356 placed on the floor circulate wildly by the air stream from the blower 355. In the case of the cycling body of a ball, the above configuration can be employed.

For example, in the case of a cycling body of soap bubbles 358, the soap bubble generator 350 is placed on the floor (the bottom surface member placed on the bottom surface of the airtight space is enough). In the present embodiment, a soap bubble generator 350 as shown in the following is used. A soap liquid reservoir 353 for storing the soap liquid is prepared. The net body 351 (the net of the size capable of forming bubbles of the desired size is used) of any shape is rotatably sustained at the high the net body soaks in soap liquid in soap liquid reservoir 353. In the present embodiment, the circular net body 351 is prepared, and a perpendicular shaft to the plane of the net body 351 is provided to the center of the net body. The shaft is arranged so that the net body 351 rotates in the shaft center. The shaft is rotatably held in the upper part of the soap liquid reservoir 353, and the shaft rotates by a driving means 357 such as motors. The net body 351 in the soap liquid reservoir 353 rotates by the shaft rotating by the driving means 357, and the net body 351 soaks in soap liquid in soap liquid reservoir 353. Furthermore, the soap bubble generator 350 of this invention is configured by the blowers 355 such as fans placed in the position sending air to the plane of the net body 351.

The soap bubble generator 350 configured as above is placed in the floor surface of the airtight space. The above blower is placed on the position where an air stream by the fan 355 provided to the bubble generator occurs in the neighboring corner from one corner, in the rectangular frame 120 from top view. A floor mechanism for game devices 100 of the present example is configured by the above configuration.

Preferred Embodiment 6

In preferred embodiment 1, the fixing member or wall 129 is placed to the floor sheet support member 122, air is sent into the space formed by the wall part 129 and floor sheet. Furthermore, the space is formed in the bag shape floor sheet 124 formed by the floor sheet 124 into bag shape. In the present embodiment, the floor mechanism for game devices 100 using the floor sheet 124 which injected liquids such as the water is explained with reference to FIG. 11. About the configuration other than injecting liquid within the floor sheet 124, because it is the same as the detailed description of the preferred embodiment 1 and 2, illustration and description is omitted.

Figure 11:
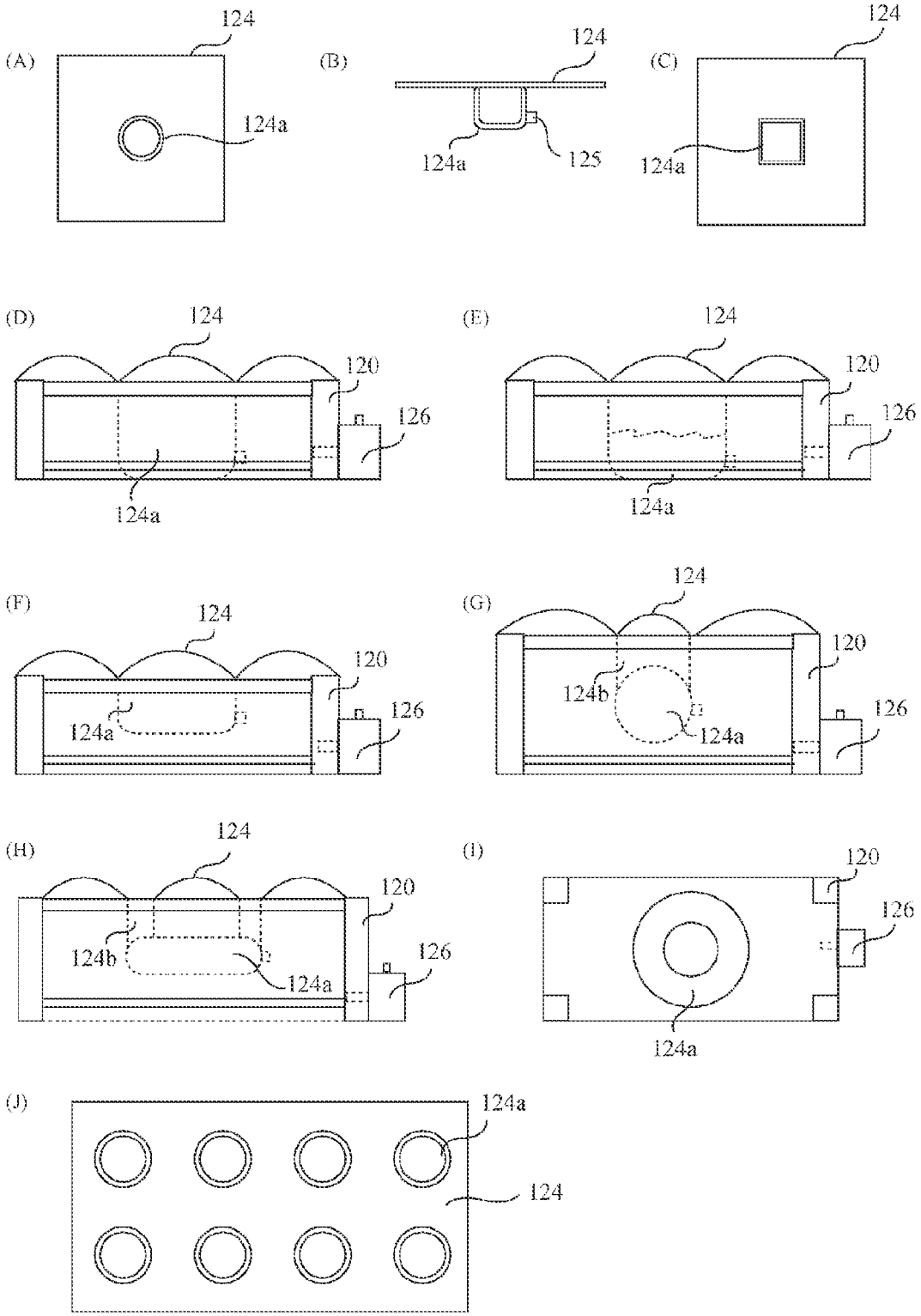
FIGS. 11(A) through 11(J) are front and plane views showing a floor sheet provided in a floor mechanism for game devices in accordance with the embodiment of this invention.

The floor sheet 124 comprising a water bag 124*a* shown in FIG. 11 (A) and FIG. 11 (B) is formed as the floor sheet 124. A water bag 124*a* is formed by a bottom surface provided to the transparent sheet formed into a tube shape.

As shown in FIG. 11 (A) and FIG. 11 (B), the floor sheet 124 comprising the space capable of watertightly shutting in liquids such as water etc. is formed by welding the opening of the water bag 124*a* formed as above in the center of the plane sheet. Any shape of the water bag 124*a* capable of shutting liquid is used. A cube type water bag 124*b* as shown in FIG. 11 (C) can be used, and form of top view polygon can be used, other than the cylindrical. Of course it is preferable that water bag 124*a* have an opening or an on-off valve 125 for injecting a liquid in the water bag.

The floor sheet 124 with the water bag configured as above is placed on the frame 120. Liquids such as water are filled in the water bag 124*a* provided to the floor sheet 124 with water bag. The reason filling the liquid in the water bag 124*a* is that the weight is added to the water bag 124*a* for getting clean line around the water bag 124*a* and for adding the convexoconcave to the floor sheet surface. Any liquid component and any filling method are used. For example, as shown in FIG. 11 (D), liquids such as water can be filled, and as shown in FIG. 11 (E), water and air can be filled in the water bag 124*a* by filling air after filling half of the liquids. The liquid can have colour. As shown in FIG. 11 (F), in the case of placing the floor sheet 124 to the frame 120, the height of the water bag 124*a* can be regulated so that the water bag 124*a* filled with liquid hung down from the floor sheet 124.

Air is sent to the floor sheet 124 with the water bag 124*a* by the blower 126 after filling the water bag 124*a* as described above. The portion of the water bag 124*a* of the floor sheet 124 expands by liquid or air, and the portion except the water bag 124*a* of the floor sheet 124 expands by the blower 126. Therefore, the convexoconcave (convex part and concave part) can be formed on the surface of the floor sheet by expanding above floor sheet 124.

The water bag 124*a* distinguished to a liquid filling part and air filling part can be formed.

For example, as shown in FIG. 11 (G), a sphere water bag 124*a*, and an air bag 124*b* for hanging the sphere water bag 124*a* linked to the upper part of the sphere water bag 124*a*, can be provided. The convexoconcave is formed in the surface of the floor sheet by filling the sphere water bag 124*a* with a colouring liquid, and filling an air bag with air. Furthermore, the sphere water bag can give the sense that the water bag floats for the users by being viewed by user playing with the floor sheet 124.

As shown in FIGS. 11 (H) and 11 (I), an annular shape water bag 124*a*, and the air bag 124*b* for hanging the annular shape water bag 124*a* linked to the upper part of the annular shape water bag 124*a*, can be provided. The convexoconcave is formed in the surface of the floor sheet 124 by filling the annular shape water bag 124*a* with a colouring liquid, and filling an air bag with air. Furthermore, the annular shape water bag 124*a* can give the sense that the water bag floats for the users by being viewed by user playing with the floor sheet.

As shown in FIG. 11 (J), a plurality of waters bag 124*a* can be provided to the floor sheet 124, and the plurality of water bags as described above can form the plurality of convexoconcaves on the floor sheet 124.

Preferred Embodiment 7

Figure 12:
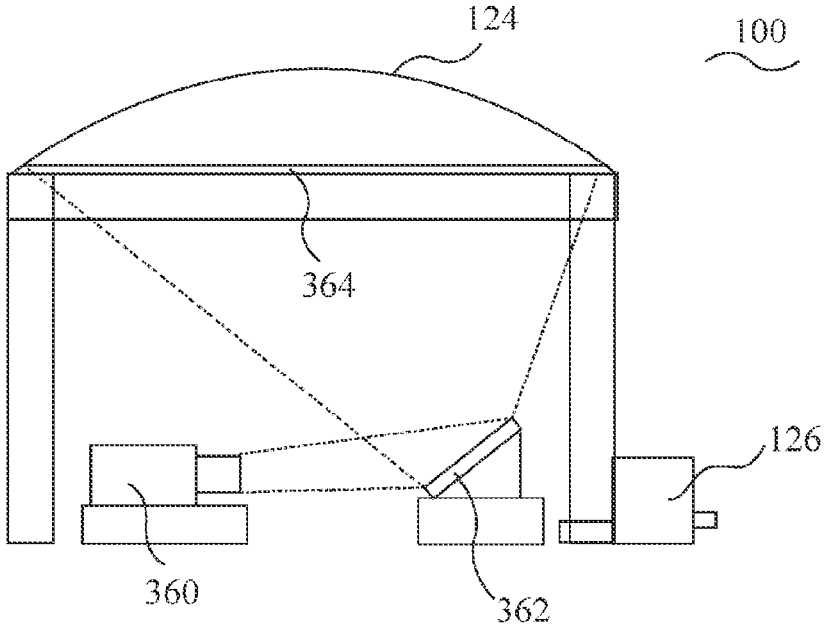
FIGS. 12(A) and 12(B) are a front and plane view illustrating an outlined configuration of a floor mechanism for game devices in accordance with an embodiment of the present invention.
Figure 12:
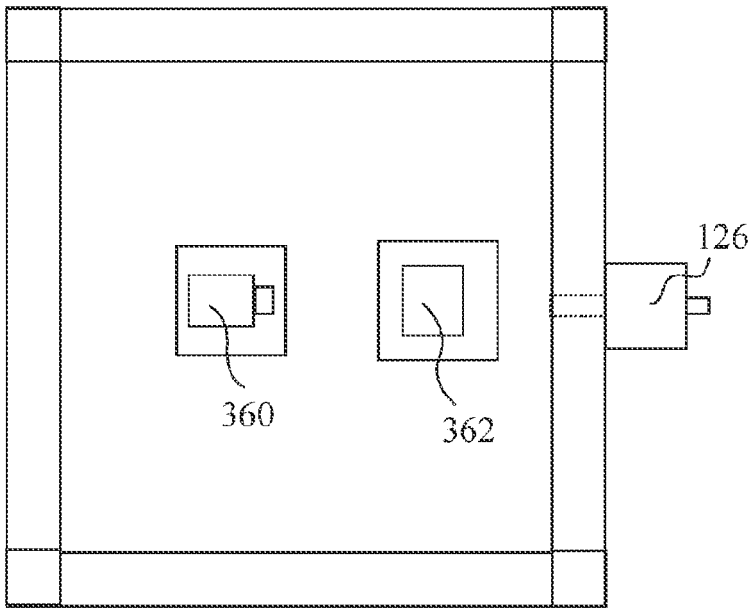

In preferred embodiment 1, the fixing member or wall 129 is placed to the floor sheet support member 122, and air is sent into the space formed by the wall part 129 and floor sheet. Furthermore, the space is formed in the bag shape floor sheet 124 formed by the floor sheet 124 into bag shape. In the present embodiment, the floor mechanism for game devices 100 capable of projecting an image on the floor sheet by projectors is explained with reference to FIG. 12. About the configuration other than projecting an image on the floor sheet 124, because it is the same as the detailed description of the preferred embodiment 1 and 2, illustration and description is omitted.

A screen 364 for image projection is provided below the floor sheet provided to the floor mechanism for game devices 100 formed of detailed description of the preferred embodiment 1. The screen 364 projects the image on the back of the screen 364, and the image can be viewed from the front (i.e., above the floor sheet 124). Therefore, the image projected from backside of the screen 364 can be viewed from the front part of the screen 364 by semitransparent screen 364.

A projection device for projecting the image on the screen is installed on the floor of backside of the screen 364. For example, as shown in FIG. 10 in the present example, a projection device 360 (a device for projecting image and a motion picture to the large-sized screens) and a projector comprising a mirror 362 are installed to the lower part of the floor sheet. The position of the projector 360 and mirror 362 is regulated so that a picture projected from the projector 360 is reflected to the mirror 362, and projected on the screen 364 for image projection. The floor mechanism for game devices of the present example is configured by providing the screen 364 and the projection device to the lower part of the floor sheet 124. The backside of the darkened space (the space formed by the screen 364 for image projection, frame 120 and surface members, within the airtight space formed by the floor sheet 124, frame 120 and surface members) can be used to increase the contrast.

Preferred Embodiment 8

In preferred embodiment 1, the fixing member or wall 129 is placed to the floor sheet support member 122, and air is sent into the space formed by the wall part 129 and floor sheet 124. Furthermore, the space is formed in the bag shape floor sheet 124 formed by the floor sheet 124 into bag shape. In the present embodiment, by using two pieces of the floor sheet 124, the floor mechanism for game devices 100 placing a lower side floor sheet below the upper side floor sheet 124 is explained with reference to FIG. 15 from FIG. 13. About the configuration other than using two pieces of the floor sheet 124, because it is the same as the detailed description of the preferred embodiment 1 and 2, illustration and description is omitted.

Figure 13:
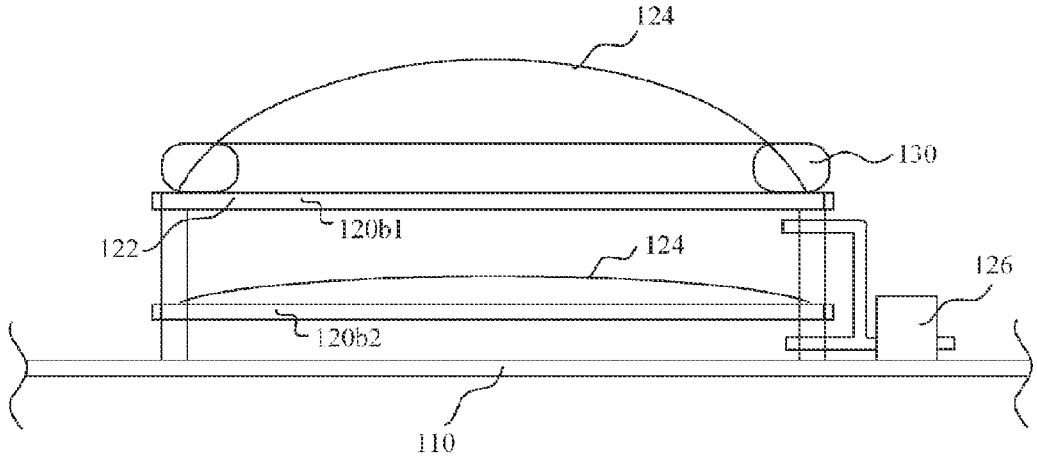
FIG. 13 is a front view illustrating an outlined configuration of a floor mechanism for game devices in accordance with an embodiment of the present invention.

A floor mechanism for game devices of the present example comprises two pieces of floor sheet 124. For example, as shown in FIG. 13, two steps of the coupling members are provided to the frame 120 of the present example. The coupling member placed downward is referred to as the lower side coupling members 120*b*2, and the coupling member placed upward is referred to as the upper side coupling member 120*b*1. A lower side floor sheet 124 is placed on the lower side coupling member 120*b*2, and an upper side floor sheet 124 is placed on the upper side coupling member 120*b*2. Furthermore, the lower side airtight space formed of the lower side floor sheet 124, the frame 120 and the side surface members is formed by providing the side surface members for the frame 120. An upper side airtight space is formed by the upper side floor sheet 124, the frame 120, side surface member and the lower side floor sheet 124.

Furthermore, the blower is provided for sending air to the upper side airtight space and the lower side airtight space. One end of the air inlet can send air to the upper side airtight space and the other end of the air inlet can send air to the lower side airtight space by the blower with branched air inlet. One blower 126 can send air to the upper airtight side and the lower side airtight space.

Figure 14:
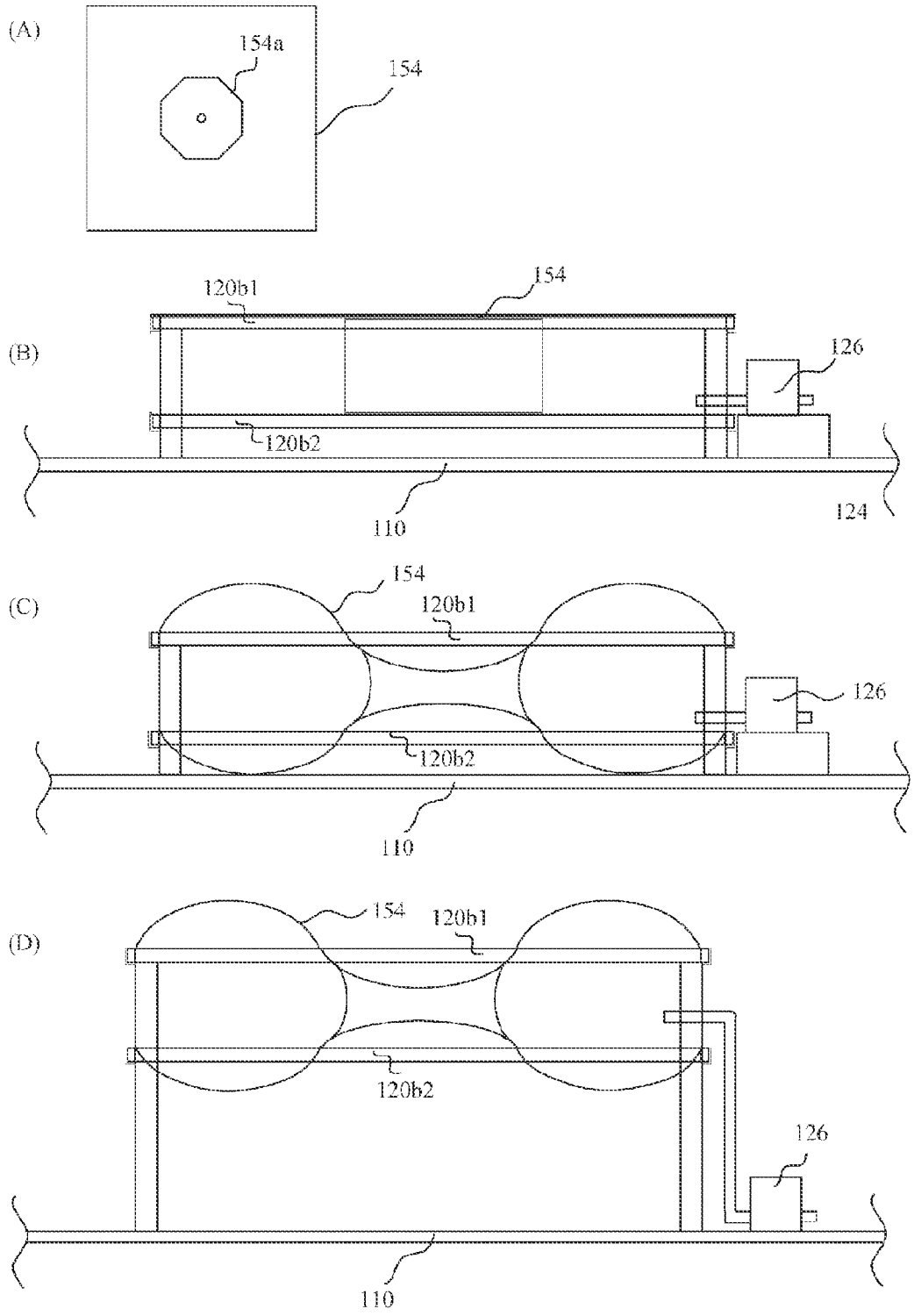
FIGS. 14(A) through 14(D) are front and plane views illustrating an outlined configuration of a floor mechanism for game devices in accordance with an embodiment of the present invention.
Figure 15:
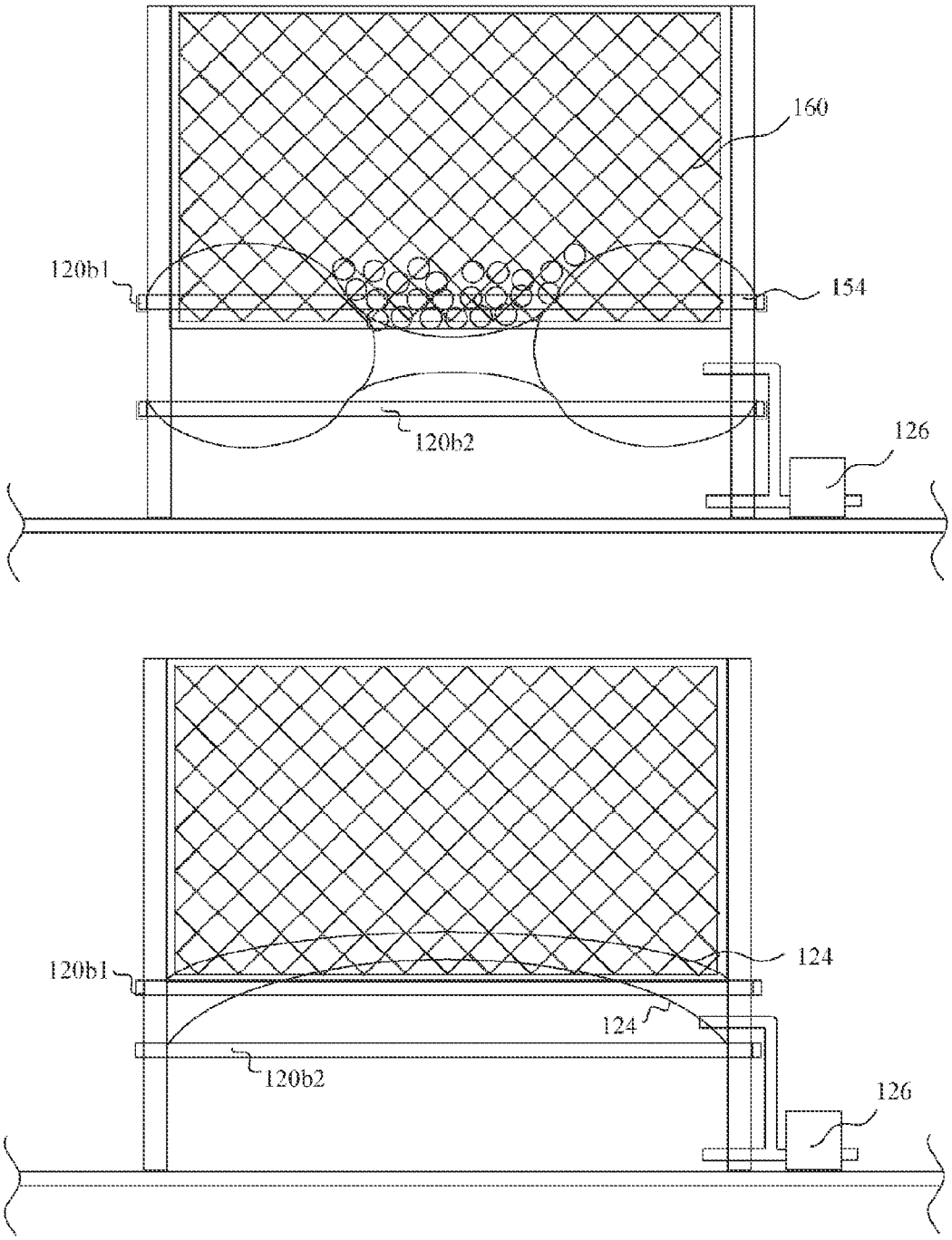
FIG. 15 is a front view illustrating a cycling mechanism of a floor mechanism for game devices in accordance with an embodiment of the present invention.

Two steps floor sheet 154 as shown in FIG. 14 can be formed. For example, two steps of floor sheet 154 are formed by stacking two pieces of the boxiness floor sheet 144 up and down and by coupling the plurality of the boxiness floor sheet 144 to each other by a tube-shaped sheet. That is, each of the two steps boxiness floor sheet 144 up and down is welded to the top and bottom ends of the tube-shaped sheet formed into a trunk form by belt-shaped sheet. The floor mechanism for game devices 100 is configured by placing two steps of floor sheet 154 to the coupling members 120*b* of the frame, and by sending the air 126 in airtight space formed by two steps of the floor sheet 154 and side surface members by blower. Alternatively, the floor mechanism for game devices 100 is configured by absorbing air in the airtight space by blower 126. A concave part is formed on the upper part of the two steps of the floor sheet 154 by absorbing the air of the airtight space by blower 126. The concave part can store balls. As shown in FIG. 15, a fall prevention sheet 160 such as nets can be put on two steps of floor sheet 154.

Preferred Embodiment 9

Figure 16:
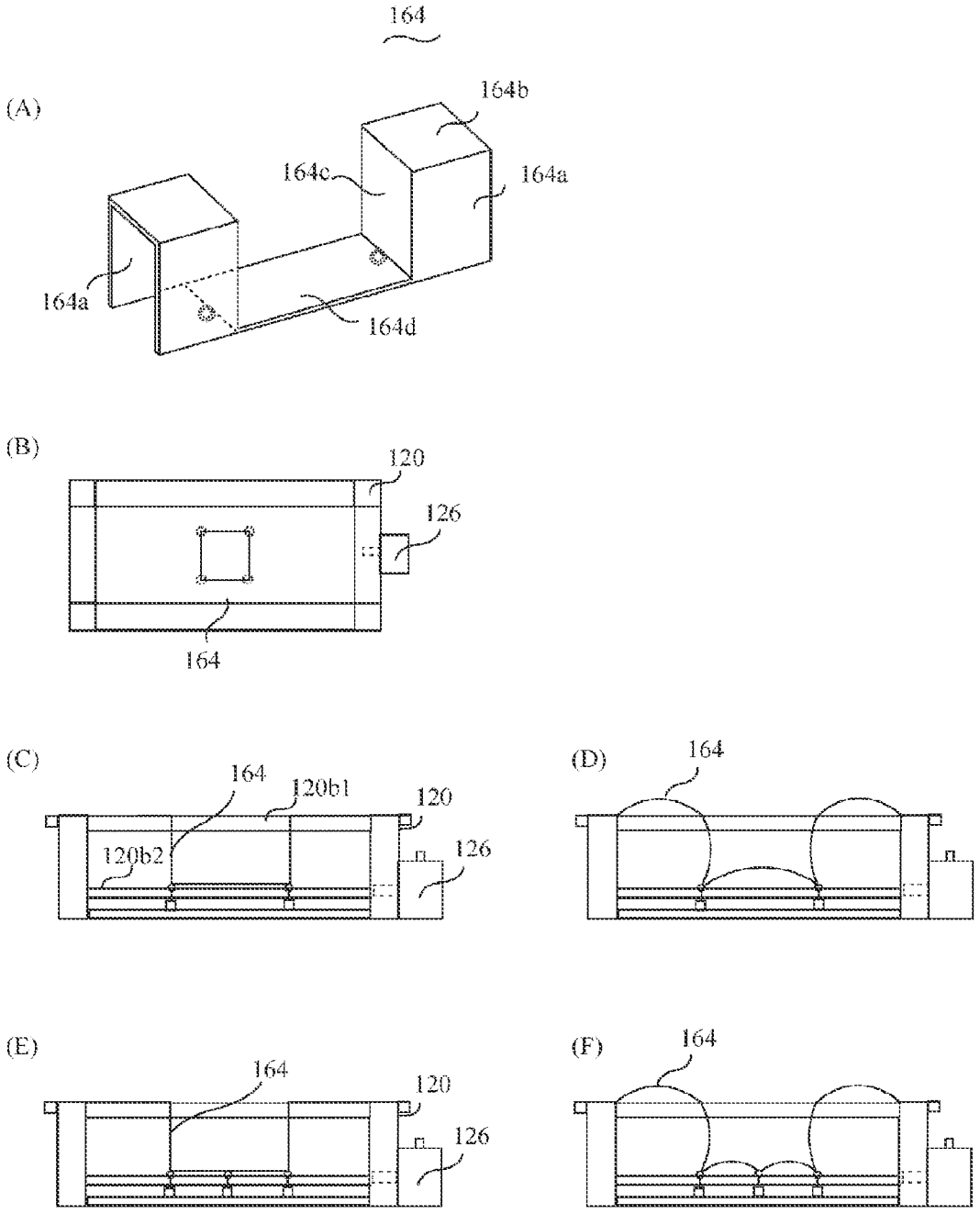
FIGS. 16(A) through 16(F) are a perspective view and front views showing a floor sheet provided in a floor mechanism for game devices in accordance with the embodiment of this invention.

A step type floor sheet 164 shown in FIG. 16 can be formed. About the configuration other than the step type floor sheet, because it is the same as the detailed description of the preferred embodiment 1 and 2, illustration and description is omitted. At first, one pair of U shaped sheet of the lateral view is formed by bending a belt-shaped sheet. That is, the form of U shaped sheet connecting two pieces of the lateral sheet 164*a* by using the top sheet 164*b* is formed. The one side surface of the U shaped sheet is closed up with the sheet, and the surface (referred to as adjacent surface 164*c*) adjacent to the top sheet 164*b* and two pieces of lateral sheet 164*a* is formed. Adjacent surface 164*c* is formed to each pair of U shaped sheets. Then, adjacent surface 164*c* of the each U shaped sheet is faced each other in the state of leaving the both ends (the both ends of the lateral view U shaped) of the pair of U shaped sheet down. A step type floor sheet 164 is formed by linking the bottom end of the adjacent surface 164*c* to the bottom sheet 164*d*. The surface adjacent to the top sheet 164*b* and two pieces of lateral sheet 164*a* can be closed by sheet, among the two surfaces opened to the pair of U shaped sheet. That is, one pair of boxiness sheet opening the other side surface is formed, in the state of leaving the open surface down, and the bottom end of the facing surfaces is linked each other by the bottom surface sheet.

The step type floor sheet 164 formed above is placed to the frame 120 configured below in the airtight condition. That is, the plurality of struts 120*a* formed into top view rectangle are vertically arranged on the floor 110. A plurality of struts 120*a* are coupled by coupling members 120*b*. At this time, as shown in FIG. 16 (C), the coupling members 120*b* are provided to top and bottom. Two top sheets 164*b* of step type floor sheet 164 are fixed to the top coupling members 120*b*1, and the bottom surface sheet 164*d* of the step type floor sheet 164 is fixed to the bottom coupling members 120*b*2. A lateral sheet 164*a* can be fixed to the top or bottom coupling members 120*b*. As described above, airtight space is formed by placing the step type floor sheet 164 to the frame 120 comprising top and bottom coupling members 120*b*1 and 120*b*2. The convexoconcave can be formed by sending or absorbing the air to the step type floor seat 164. As shown in FIG. 16 (E) and FIG. 16 (F), furthermore, the convexoconcave can be formed by fixing the center portion of the bottom surface sheet 164*d* to the floor plate.

Preferred Embodiment 10

A game device comprising the floor mechanism for game devices 100 configured above can be configured. For example, a slide type game device (hereinafter called slide) 390 shown in FIG. 17 can be configured. A slope frame is formed by coupling the slant struts 120*a* of the frame 120*b* each other by slant coupling members 120*c*. The horizontal floor sheet 124 or boxiness floor sheet 144 is placed to the coupling members 120*c*, and the slide 390 can be configured by sending out air to the airtight space formed by the floor sheet 124 and formed by the side surface members provided to the frame side, by using an air sending means such as the blower 126. Convexoconcave can be formed to the slide 390. Floor sheet 174 for slides is formed by welding a plurality of tube-shaped sheets 174*a* capable of housing the drawbar 180 to the rear face of the floor sheet 124 at prescribed intervals. A board member is placed to the coupling members 120*c* of the slope frame. A fixing member 183 capable of fixing the drawbar 180 of the tube-shaped sheets 174*a* is fixed to the board member 182. The game device comprising the floor mechanism for game devices 100 is formed by above configuration. In the floor sheet 124, the part pulled with the drawbar 180 is the concave part, and other parts is the convex part. The user can slide down the concave part.

Figure 17:
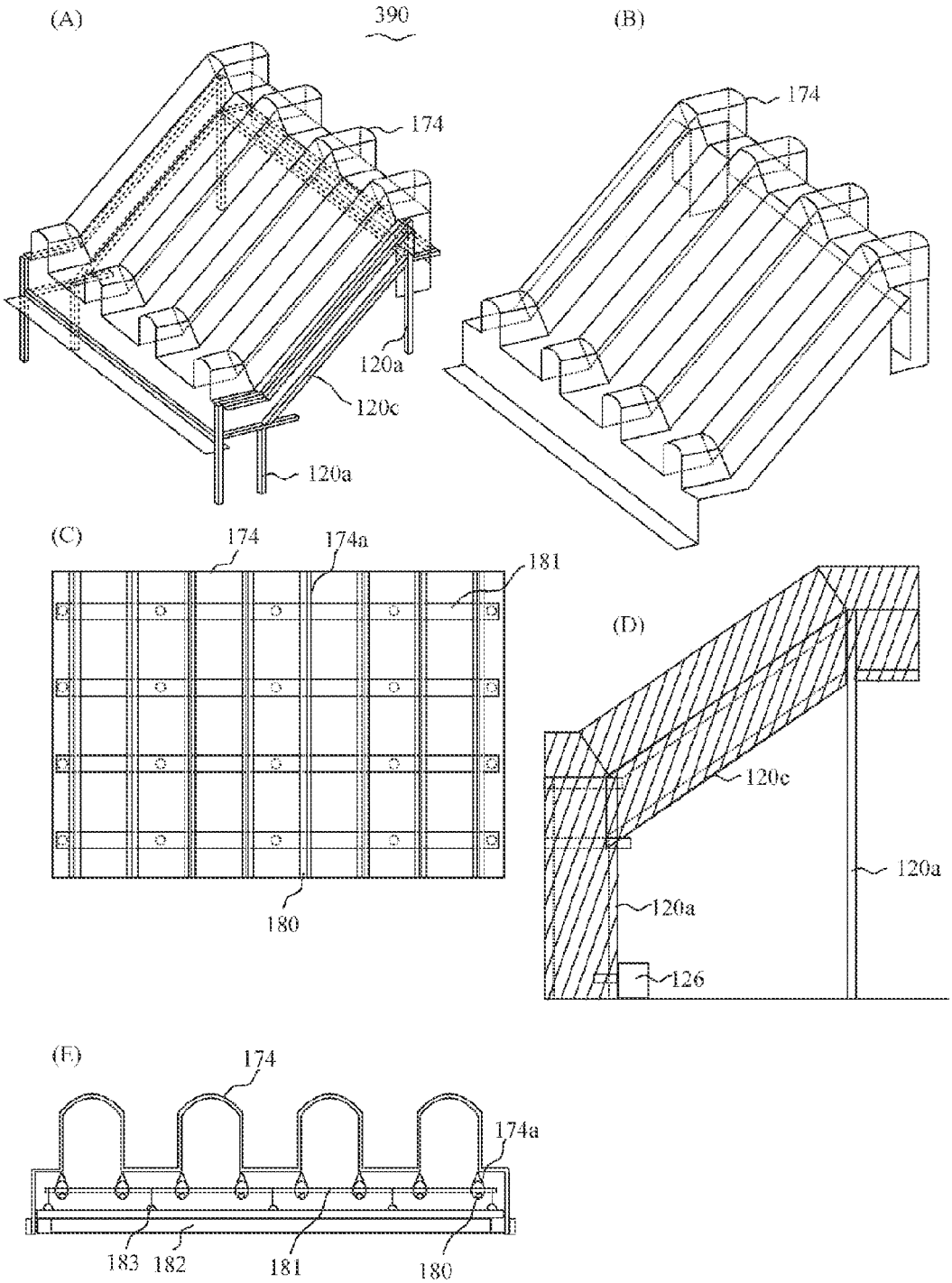
FIGS. 17(A) through (E) are perspective, front, and plane views showing the example of a game device using a floor mechanism for game devices in accordance with the embodiment of this invention.
Figure 18:
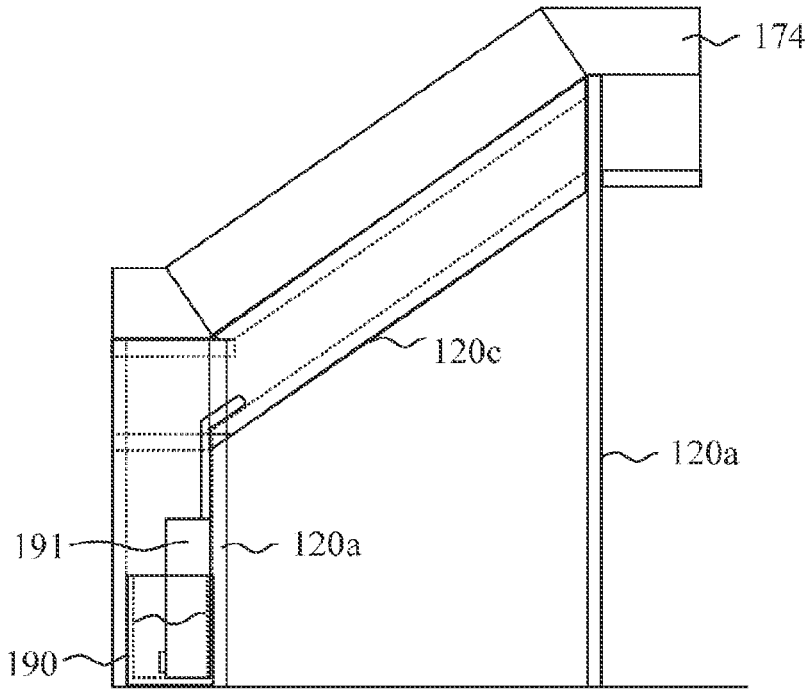
FIGS. 18(A) and 18(B) are side views showing the example of a game device using a floor mechanism for game devices in accordance with the embodiment of this invention.
Figure 18:
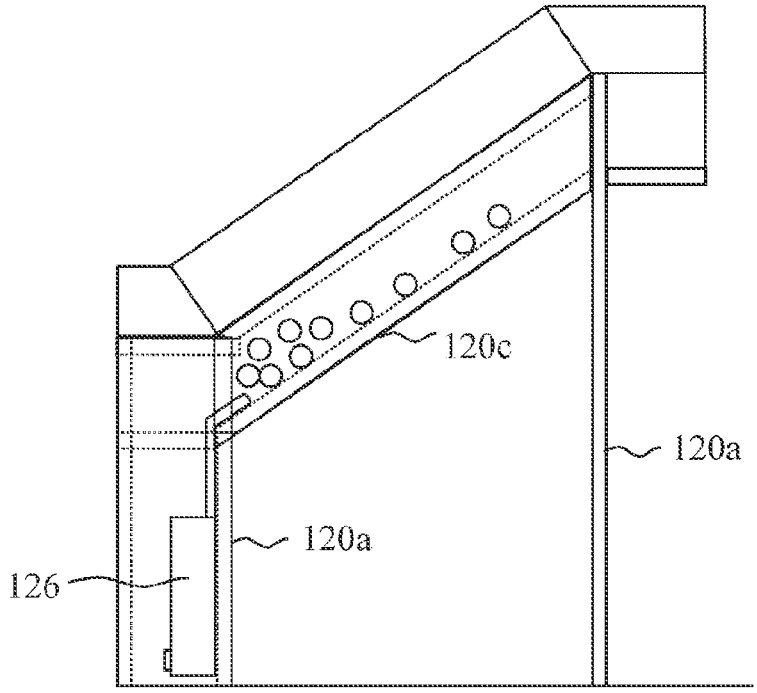
Figure 19:
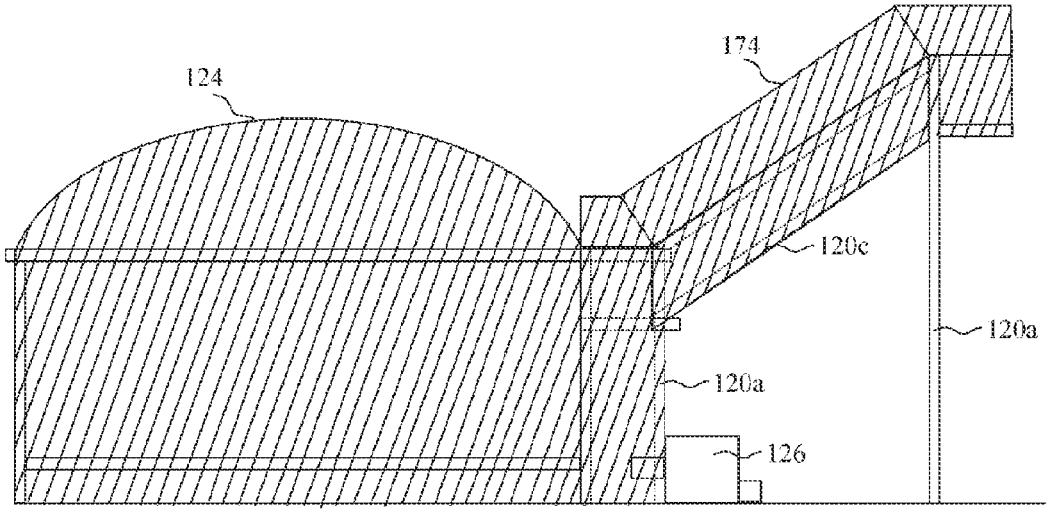
FIG. 19 is a side view showing the example of a game device using a floor mechanism for game devices in accordance with the embodiment of this invention.

In the present embodiment, a shaded part shown in FIG. 17 (D) shows for airtight space. Airtight space is formed in the main body of the slide 390 and in the slope frame for fixing the slide. A water cycling mechanism and a ball cycling mechanism can be placed in the airtight space formed in the slope frame. For example, the slide 390 including the water cycling mechanism provided to the slope frame is showed in the FIG. 18 (A). That is, the water cycling mechanism placed in the lower portion of the slope frame is comprised with a bathtub 190 for being filled with water, and comprised with a submersible pump 191 having an injection Up. Water in the bathtub 190 jets to a ramp portion of the slide 390 from injection tip of the submersible pump 191, and the jetting water returns within the bathtub 190 again. FIG. 18 (B) show the slide 390 comprising the ball cycling mechanism. That is, the ball cycling mechanism placed in the lower portion of the slope frame is comprised with a ball placed to the slide ramp portion and with a blower 126 for cycling the ball. By placing a ball to the slide ramp portion, the ball is cycled with a cycling device of the blower 126, etc. and climbing the slope and sliding the slope. The above is repeated. Using the blower different from the blower 126 sending air to the slide 390, a ball is circulated. The slide 390 and the floor mechanism for game devices 100 comprising the floor sheet can be combined. FIG. 19 show the figure combining the floor mechanism for game devices with slide 390. A shaded area show the airtight space portion.

Figure 20:
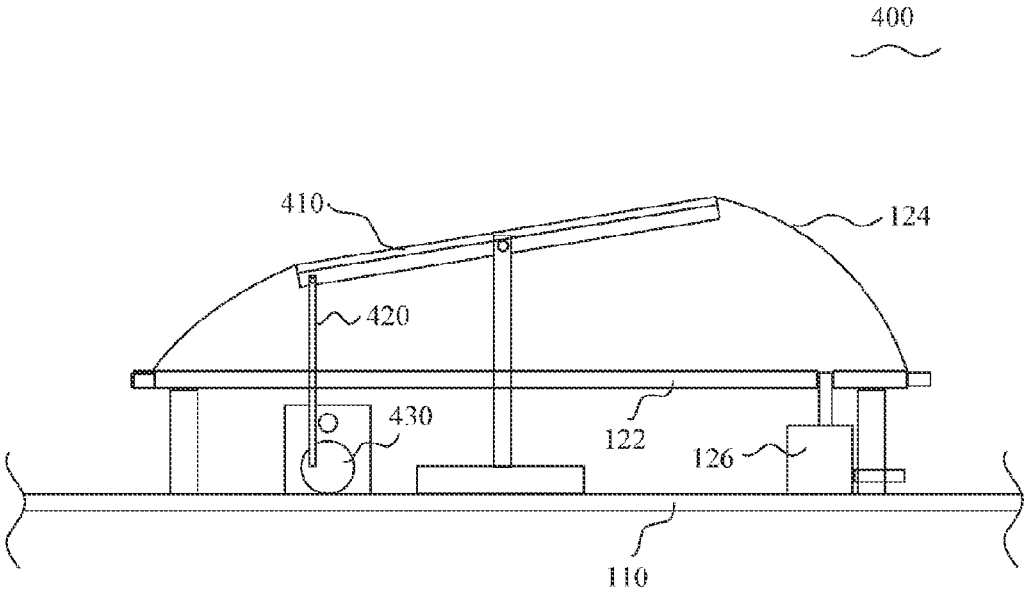
FIG. 20 is a side view showing the example of a game device using a floor mechanism for game devices in accordance with the embodiment of this invention.

As another configuration of the game device, for example, seesaw type game device (hereinafter called seesaw) 400 which configured floor sheet 124 into a seesaw shape is explained with reference to FIG. 20. About the configuration except the floor sheet 124 of the seesaw shape, because it is the same as detailed description of the preferred embodiment 1, illustration description is omitted. A crank 420 is configured to move up and down by rotating a gear 430 providing a crank 420 by a drive motor. On the other hand, a rotatable shaft by bearings and rectangle floor plate 410 are formed, and the shaft is connected substantially to center of the longer direction of the floor plate 410. At this time, the shaft is connected to the floor plate 410, in the condition of being parallel to the shorter direction of the floor plate 410. The floor plate 410 is configured into a seesaw form by fixing the other end (in the side opposite to providing the gear) of the crank 420 to the other end of the floor plate 410 configured above. Any shape of the seesaw-shaped floor plate 410 is used, in the condition so that the shaft can rotate to given angle for forwardly and reversely. For example, it may be a rightness shape and a triangle shape, a circle shape, or an oval configuration.

The floor sheet 124 of this invention is connected to the seesaw-shaped floor plate 410 configured above. That is, the floor sheet 124 used with the detailed description of the preferred embodiment 1 is connected circumferentially to the floor plate 410. The floor sheet 124 used with the detailed description of the preferred embodiment 1 can be put on the surface (in the surface opposite to connecting the shaft) of the floor plate 410. By configuring in this way, the crank 420 performs up-and-down motion by the rotation of the drive motor, and a floor plate 410 performs up-and-down motion around the shaft. Furthermore, the floor sheet 124 is moved up and down by the floor plate 410 to perform up-and-down motion. Of course the floor sheet 124 is swelled out because air is sent by the blower 126, etc. Thus, the game device (seesaw 400) using a floor mechanism for game devices 100 displaced up and down can be configured in the condition being swelled out by the blower 126.

Of course, without the drive motor, a rotatable shaft by bearings and rectangle floor plate 410 are formed, and the seesaw can be formed by connecting the shaft substantially to the center of the longer direction of the floor plate 410. At this time, the shaft is connected to the floor plate 410, in the condition of being parallel to the shorter direction of the floor plate 410. The floor sheet 124 of this invention is connected to the seesaw-shaped floor plate 410 configured above. That is, the floor sheet 124 used with detailed description of the preferred embodiment 1 is connected circumferentially to the floor plate 410. The floor sheet 124 used with the detailed description of the preferred embodiment 1 can be put on the surface (in the surface opposite to connecting the shaft) of the floor plate 410. By configuring in this way, the floor plate 410 performs up-and-down motion around the shaft by the movement of the user on the seesaw.

Preferred Embodiment 11

Figure 21:
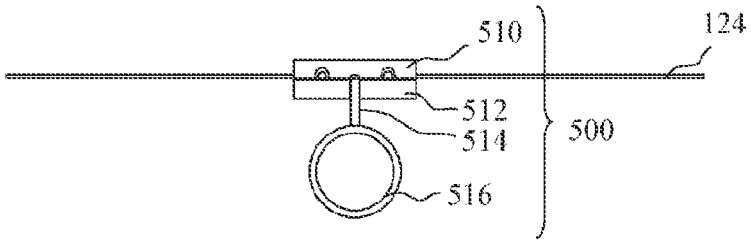
FIGS. 21(A) through 21(D) are front and plane views showing an example of the connector for using a floor mechanism for game devices in accordance with the embodiment of this invention.
Figure 21:
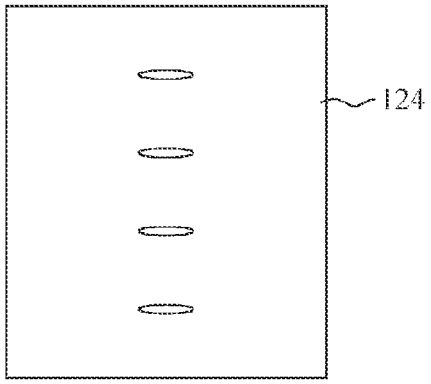
Figure 21:
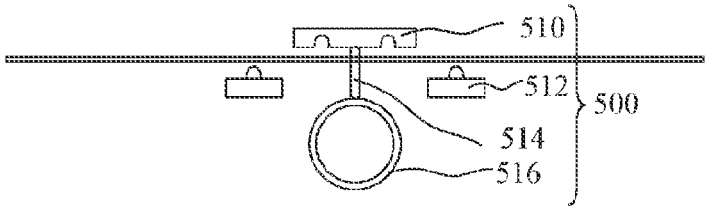
Figure 21:
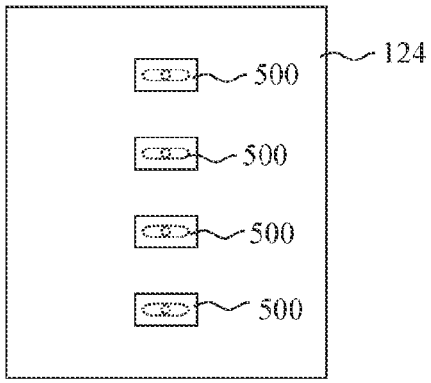

Next, a connector for forming a hook (e.g., a hook provided on wall, a fixing member provided to the elastic sheet) on an inner wall of the elastic sheet (e.g., floor sheet 126) used by the floor mechanism for game devices 100 of this invention is explained. The configuration of the frame of the floor mechanism for game devices 100 is the same as the detailed description of the preferred embodiment 1, therefore illustration and description is omitted. FIG. 21 shows forming a hook 516 to the elastic sheet used by the floor mechanism for game devices 100 of this invention. However, the details of all parts which do not directly-relate to the present invention will be omitted.

An upper connector 510 providing the hook and bottom connector 512 capable of fitting the upper connector 510 are formed. For example, upper connector 510 is formed by fixing a string 514 hung by the hook 516 to rectangular female connector. A male connector for fitting the female connector is formed as a bottom connector 512. At this time, one pair of male connectors is formed, and the size of the bottom connector 512 is regulated so that the upper connector 510 and the bottom connector 512 are engaged in the condition sandwiching the string 514 fixed to the female connector between the pair of the male connectors. The connector 500 is configured by configuring as above. Of course, a male connector is used for the upper connector 510 and may use a female connector for bottom connector 512.

A hook 516 can be formed on the elastic sheet by engaging each connector configured as above to the elastic sheet. A slit capable of piercing through the hook 516 is formed to the desired point to form the hook 516 to the elastic sheet. The hook 516 pierces through the slit, and the upper connector 510 contacts the elastic sheet. That is, the upper connector 510 contacts the elastic sheet, in the condition that the string 514 of the upper connector 510 inserts into the slit. A pair of the bottom connectors engage to the upper connector 510. At this time, the hook 516 is formed to the elastic sheet by interdigitating the upper connector 510 to the bottom connector 512, in the condition sandwiching the string 514 between the pair of bottom connectors 512.

Figure 22:
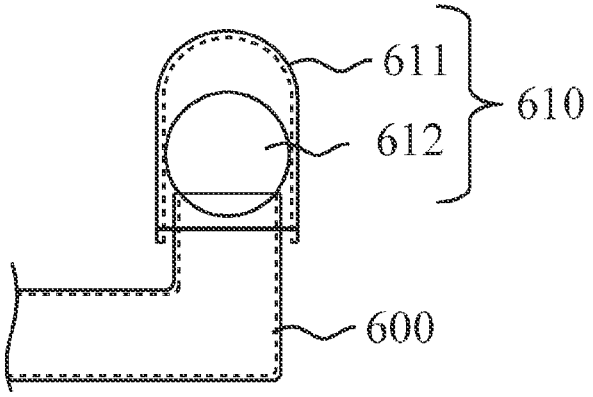
FIGS. 22(A) and 22(B) are front views showing an example of the valve for using for a floor mechanism for game devices in accordance with the embodiment of this invention.
Figure 22:
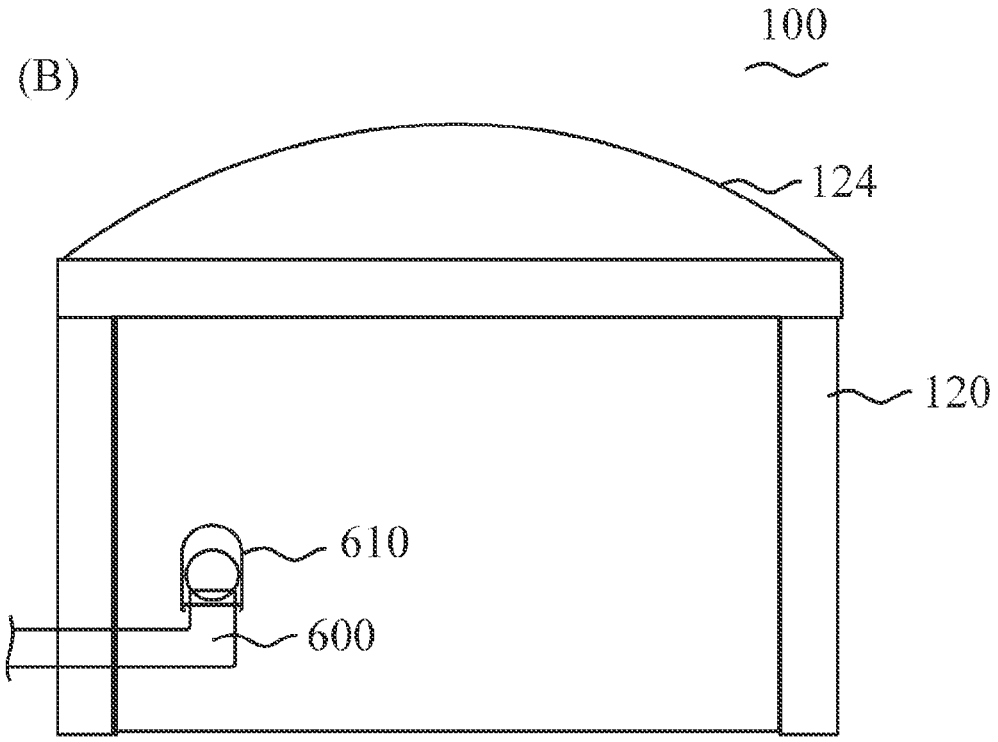

Furthermore, an air leak prevention valve 610 for preventing leaking air sent to the floor mechanism for game devices 100 can be provided. An air leak prevention valve 610 used in the present embodiment is explained with referring to FIG. 22. At first, a trunk body 611 (the shape formed by blocking up one opening of the trunk body) is formed. The inside diameter of the trunk body 611 is formed so as to be larger in size than the external diameter of the air flowpath. A ball 612 having an external diameter the same as the inside diameter of the trunk body 611 is placed to the edge (i.e., the edge of the air flowpath 600 inserted inside of the floor mechanism for game devices 100 of this invention) of air flowpath 600. Furthermore, an open end of the trunk body 611 is inserted and fixed on the edge of the air flowpath placing the ball 612. At this time, the air leak prevention valve 610 is configured by fixing the trunk body 611 on the air flowpath 601 with opening the clearance for moving the ball up and down. When air is not sent, the ball 612 is placed on the air flowpath by configuring as above.

The air flow occurs through the direction for lifting the ball 612 when air is sent to the floor mechanism for game devices 100, the ball 612 of the air leak prevention valve 610 moves upwardly, and clearance between the edges of the air flowpath 600 and the ball 612 is formed. Air through air flowpath 600 is sent from the clearance. On the other hand, air flow occurs through the direction for falling the ball 612 when the air leaks out outside by user playing with the floor mechanism for game devices 100. Therefore, the ball 612 of the air leak prevention valve 610 moves downwardly, and clearance between the edges of the air flowpath 600 and the ball 612 is closed. Therefore, air leak is prevented. Other than the above, a pressure regulating valve for preventing leak of the air, with keeping the pressure of the air in the floor mechanism for game devices 100 constant, by sending out air larger than a predetermined pressure, can be provided to the edge of the air flowpath 600.

Preferred Embodiment 12

Hereinafter, a present embodiment of the game device using a floor mechanism for game devices 100 of this invention is explained with reference to FIG. 23, FIG. 24, FIG. 25, and FIG. 26. Each drawing is an embodiment of the game device using the floor mechanism for game devices of this invention.

Figure 23:
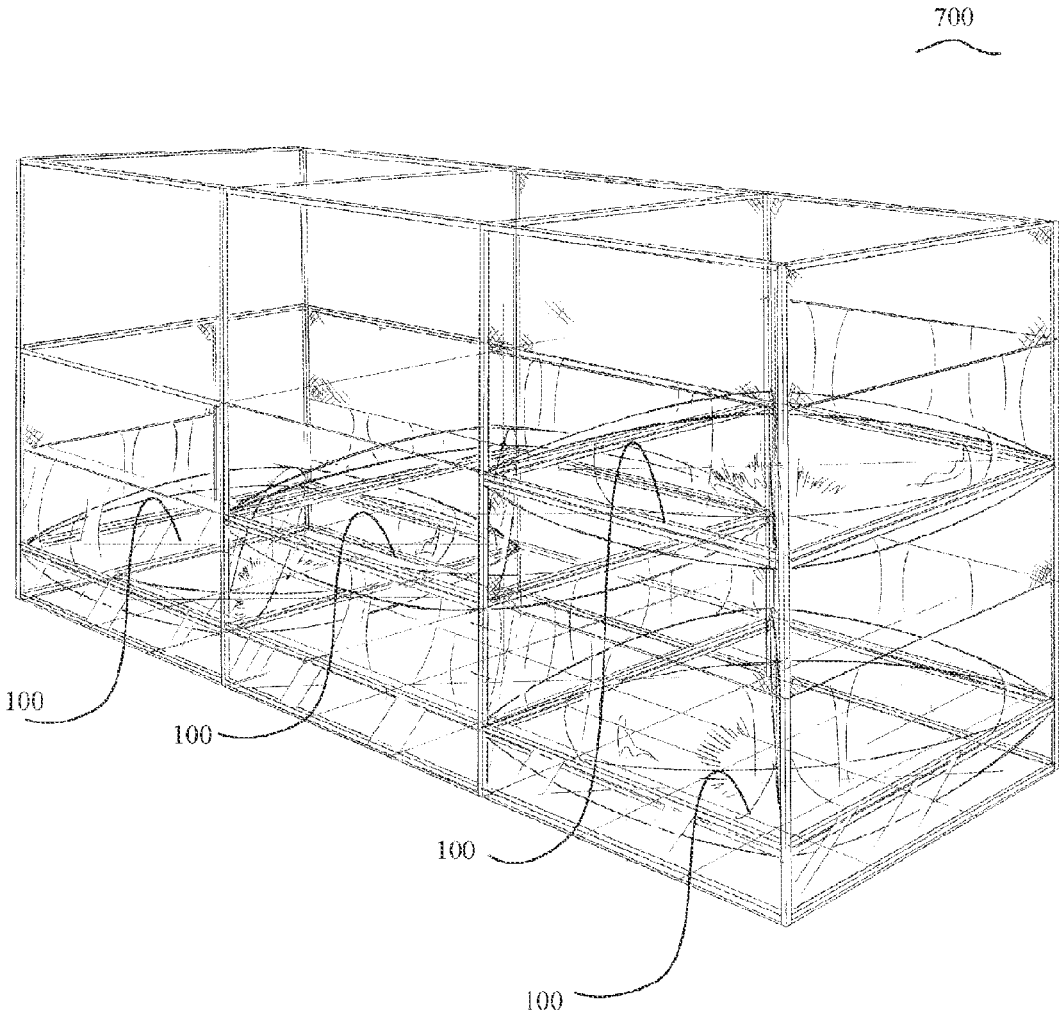
FIG. 23 is a perspective view showing an example of a game device using a floor mechanism for game devices in accordance with the embodiment of this invention.
Figure 24:
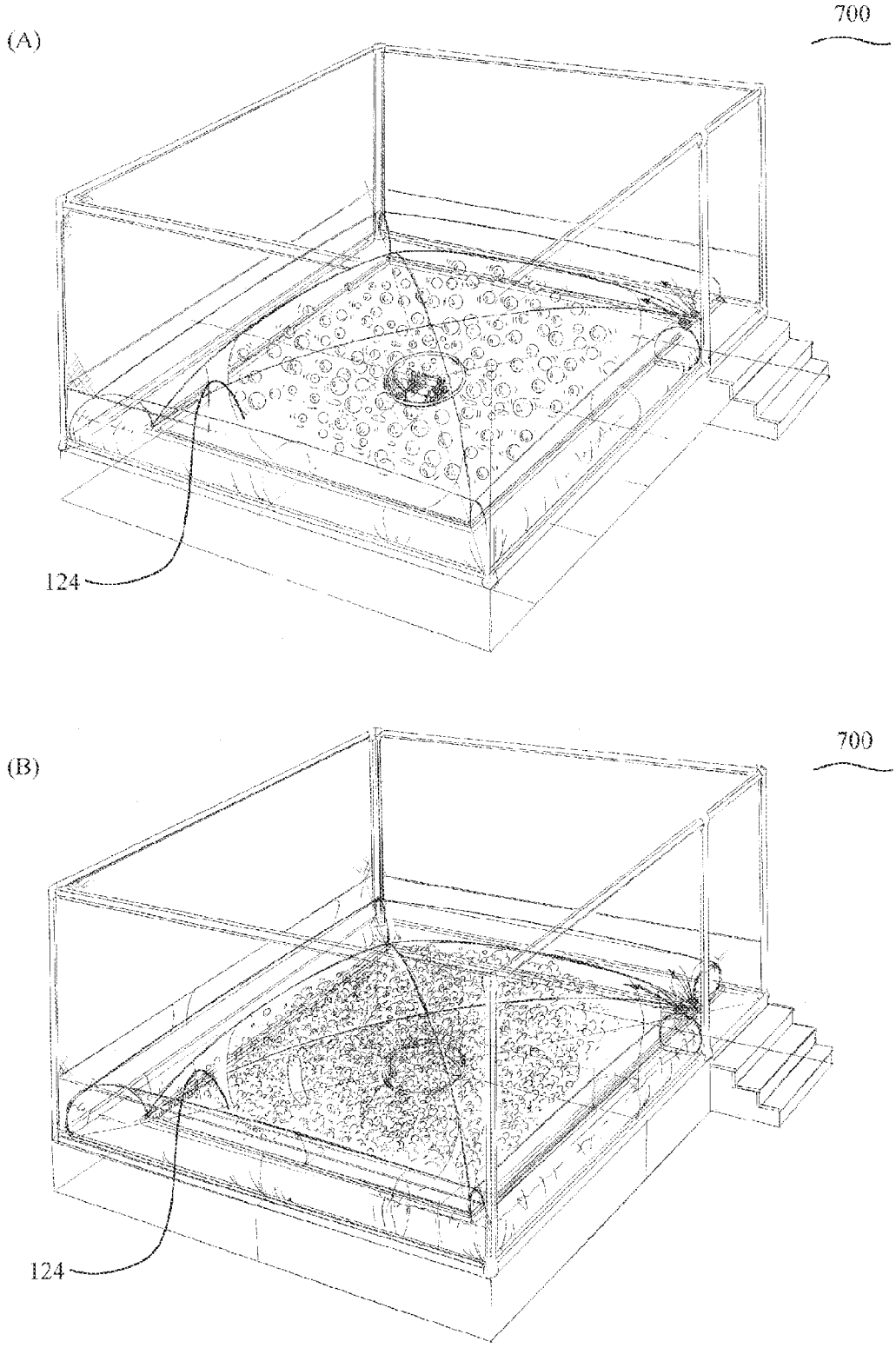
FIGS. 24(A) and 24(B) are perspective views showing the example of a game device using a floor mechanism for game devices in accordance with the embodiment of this invention.

FIG. 23 is a game device 700 arranging stepwisely the floor mechanism for game devices 100 of this invention. Users can move between the upper and bottom. Of course, a net for preventing user's dropping is put as an external wall of stepwise game device 700. FIG. 24 is game device 700 comprising a soap bubbles mechanism to the floor mechanism for game devices 100 of this invention. FIG. 24 (A) is a game device 700 configured to fly soap bubbles into the airtight space. FIG. 24 (B) is a game device 700 configured to flow the form like soap bubbles into the airtight space. A part of the frame member is omitted for emphasizing the floor sheet 124.

Figure 25:
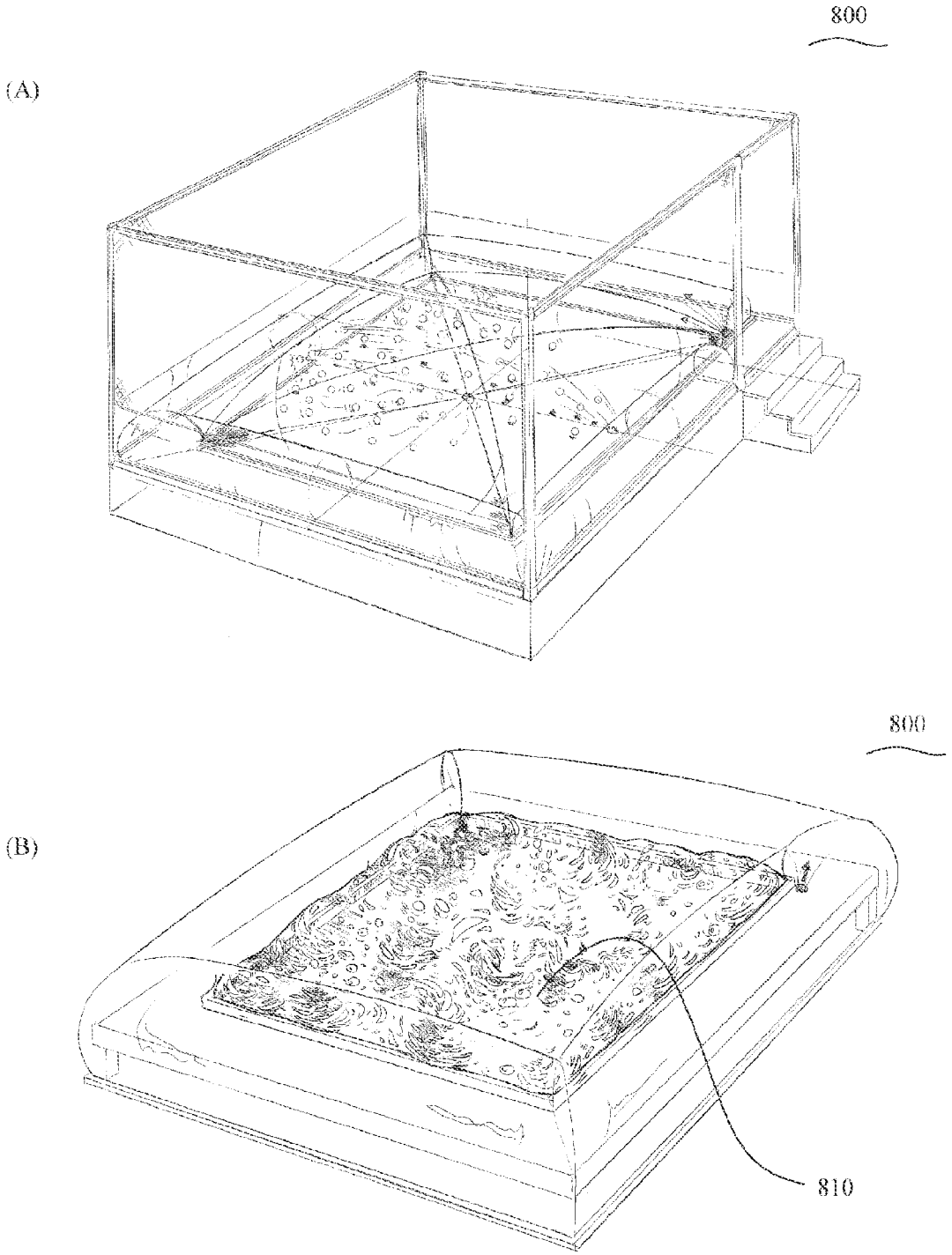
FIGS. 25(A) and 25(B) are perspective views showing the example of a game device using a floor mechanism for game devices in accordance with the embodiment of this invention.
Figure 26:
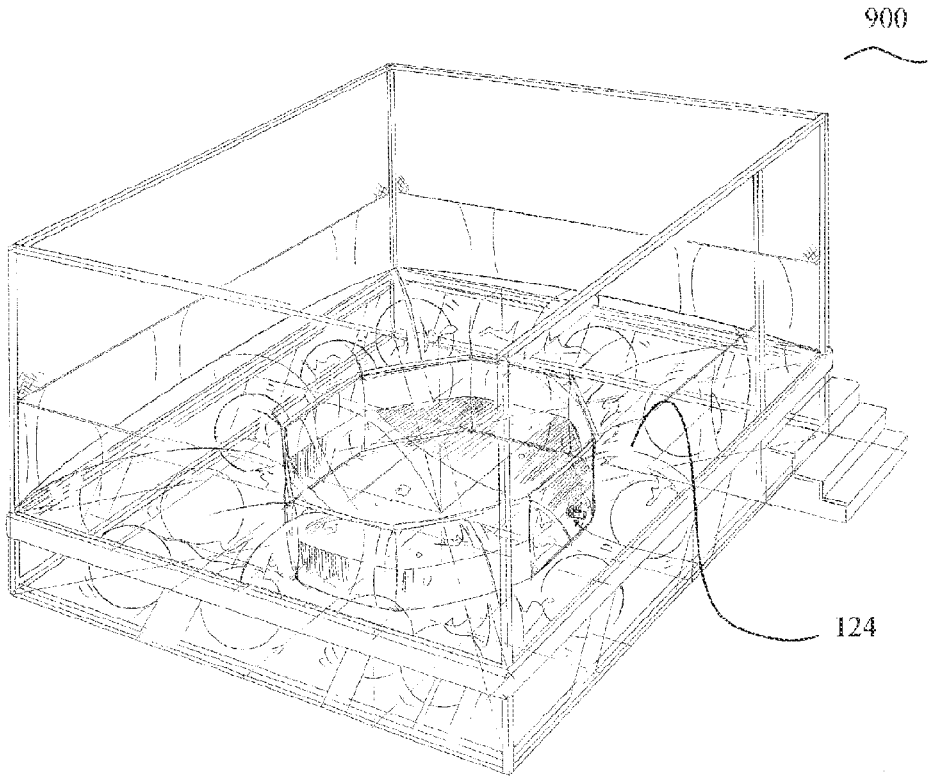
FIGS. 26(A) and 26(B) are perspective views showing the example of a game device using a floor mechanism for game devices in accordance with the embodiment of this invention.
Figure 26:
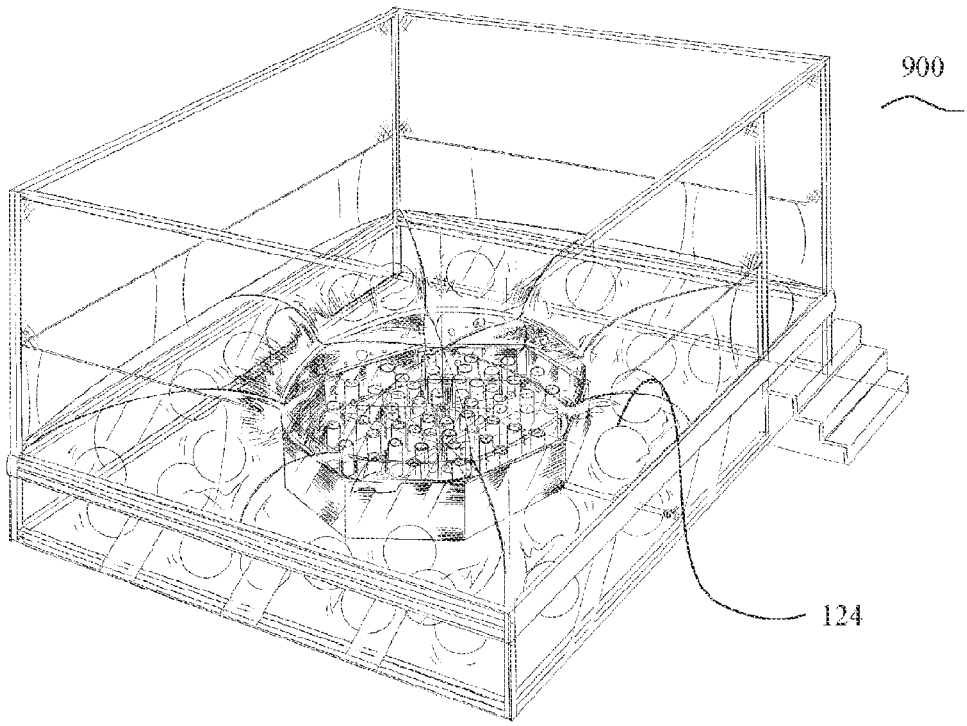

FIG. 25 (A) is game device 800 comprising the mechanism (ball cycling mechanism 200) to fly a ball to the floor mechanism for game devices 100 of this invention. FIG. 25 (B) is game device 810 filled with a gel fluid (fluid having the moderate viscosity not to be sticky in a hand and having the coolly wet feel) into the airtight space of the floor mechanism for game devices 100 of this invention. FIG. 26 is the game device 900 having the swelling on the center of the floor sheet of the floor mechanism for game devices 100 of this invention. FIG. 26 (A) shows placing the water in the space of the center part. FIG. 26 (B) shows the drawing for vertically arranging a plurality of transparent trunk body to a bathtub placed in the center space, and the drawing ornamenting mirrors, etc. to inner wall of the bathtub. A part of the frame member is omitted for emphasizing the floor sheet.

INDUSTRIAL APPLICABILITY

The present invention is a floor mechanism for game devices comprising a frame, a floor sheet, and an air suction/sending means. The frame comprises a plurality of struts vertically arranged on the floor and a coupling member for coupling the adjacent of said plurality of struts. The floor sheet is arranged in an airtight state on the coupling members for the frame, and the air suction/sending means sends air to or sucks air from an airtight space formed by side surface members provided in the frame and the floor sheet. The floor mechanism is characterized by forming the airtight space as a result of the floor sheet being fixed to the frame by a fixing means.

By the above configuration, the floor sheet body swells out by sending out air by an air sending means. A floor sheet will be moved up and down by user's jumping over the floor sheet body. The game device, which can continue the interest of the user for a long time, can be configured by a floor moving up and down as above.

What is claimed is:

1. A floor mechanism for a game device, comprising:

a plurality of struts vertically arranged on a floor, a frame comprising a plurality of coupling members for coupling adjacent ones of said plurality of struts, a floor sheet air-tightly placed to the coupling members of the frame, and an air suction/sending means for sending or absorbing air in an air-tight space formed by one or more side members provided to the frame and the floor sheet, the floor mechanism is characterized by forming the air-tight space as a result of the floor sheet being fixed to the frame by a first fixing means.

2. The floor mechanism for a game device according to claim 1, wherein said floor sheet is a boxiness floor sheet formed by erecting all corners and sides of the floor sheet to define an erected sheet, the corners of the erected sheet of the boxiness floor sheet are fixed to inside corners of the frame by a second fixing means, and the sides of the erected sheet are fixed to inside sides of the frame by the second fixing means.

3. The floor mechanism for a game device according to claim 2, wherein said second fixing means for fixing at least one of the corners of the erected sheet of the floor sheet to an inside corner of the frame is an angle type clamp.

4. The floor mechanism for a game device according to claim 2, wherein two steps of the floor sheet are provided formed by stacking two pieces of the boxiness floor sheet up and down and by coupling the plurality of the boxiness floor sheets to each other by a tube-shaped sheet, each boxiness floor sheet of the two steps of floor sheet is placed air-tightly to top and bottom coupling members of the frame.

5. The floor mechanism for a game device according to claim 1, wherein said floor sheet comprises a translucent member.

6. The floor mechanism for a game device according to claim 1, wherein said floor sheet is a bag shaped floor sheet comprising two pieces of transparence sheet, the air suction/sending means sends out air to space in the bag shaped floor sheet.

7. The floor mechanism for a game device according to claim 1, further comprising a concave part formed on an upper part of the floor sheet by absorbing air in the floor sheet by the air suction/sending means, a ball placed in the concave part.

8. The floor mechanism for a game device according to claim 1, further comprising a cycling mechanism for circulating a cycling body placed in a lower part of the floor sheet, and the cycling body is circulated in the floor sheet in which air is sent in by the air suction/sending means.

9. The floor mechanism for a game device according to claim 8, further comprising said cycling body circulates near a support member and the floor sheet placed on the coupling members, said cycling mechanism comprising:

a receiving side flowpath for receiving the cycling body dropped from the air-tight space in the floor sheet, a sending side flowpath for ejecting the cycling body received by the receiving side flowpath to the air-tight space in the floor sheet, and a cycling device for sending the cycling body to the floor sheet via the sending side flowpath.

10. The floor mechanism for a game device according to claim 9, wherein said cycling body is a ball placed on the support member, the ball being circulated in the frame by a blower provided for the cycling mechanism.

11. The floor mechanism for a game device according to claim 9, wherein said cycling body is water, and said cycling device is a submersible pump, a nozzle provided at an end of the sending side flowpath gushes water.

12. The floor mechanism for a game device according to claim 8, wherein said cycling body is a ball placed on a frame undersurface, the ball being circulated in the frame by a blower provided for the cycling mechanism.

13. The floor mechanism for a game device according to claim 1, further comprising said floor sheet is a water bag floor sheet, wherein the water bag is capable of being filled watertightly with a liquid.

14. The floor mechanism for a game device according to claim 1, further comprising a cushioning material provided around the floor sheet.

15. The floor mechanism for a game device according to claim 1, wherein said game device is a slide type game device, at least one of said coupling members is a slant coupling member for slantly coupling between the struts, a plurality of tube-shaped sheets provided on a back surface of the floor sheet, a drawbar housed in the tube-shaped sheets, a convexoconcave slide being formed on the floor sheet by fixing the drawbar to a board member placed on the slant coupling member.

16. The floor mechanism for a game device according to claim 1, further comprising a connector for forming a hook in the floor sheet, the connector comprising an upper connector, and a string provided on an under surface of the upper connector for hanging the hook, a pair of bottom connectors engaged with the upper connector, in the condition of sandwiching the string provided to the upper connector.

17. The floor mechanism for a game device according to claim 1, wherein said game device is a seesaw type.

18. A plurality of floor mechanisms for a game device, comprising:

a plurality of struts vertically arranged on a floor, a frame comprising a plurality of coupling members for coupling adjacent ones of said plurality of struts, a floor sheet air-tightly placed to the coupling members of the frame, an air suction/sending means for sending or absorbing air in an air-tight space formed by one or more side members provided to the frame and the floor sheet, the air suction/sending means being commonly used for sending out air to each of said plurality of floor mechanisms, and a pipe for connecting air-tightly between each floor mechanism, the floor mechanism being characterized by forming the air-tight space as a result of the floor sheet being fixed to the frame by a fixing means.

* * * * *